US008500245B2

(12) United States Patent
Hagiwara et al.

(10) Patent No.: US 8,500,245 B2
(45) Date of Patent: Aug. 6, 2013

(54) LIQUID EJECTING HEAD UNIT AND MANUFACTURING METHOD THEREOF

(75) Inventors: Hiroyuki Hagiwara, Matsumoto (JP); Munehide Kanaya, Azumino (JP); Daisuke Hiruma, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 90 days.

(21) Appl. No.: 13/313,139

(22) Filed: Dec. 7, 2011

(65) Prior Publication Data

US 2012/0147094 A1 Jun. 14, 2012

(30) Foreign Application Priority Data

Dec. 10, 2010 (JP) ..... 2010-275423

(51) Int. Cl.
*B41J 29/393* (2006.01)

(52) U.S. Cl.
USPC ..... 347/40; 347/19

(58) Field of Classification Search
USPC ..... 347/12, 15, 40, 43
See application file for complete search history.

(56) References Cited

U.S. PATENT DOCUMENTS 4,599,627 A * 7/1986 Vollert ..... 347/20
6,244,688 B1 * 6/2001 Hickman ..... 347/43
6,315,387 B1 * 11/2001 Horikoshi ..... 347/40

FOREIGN PATENT DOCUMENTS

JP 2008-273109 11/2008

* cited by examiner

*Primary Examiner* — Lamson Nguyen
(74) *Attorney, Agent, or Firm* — Workman Nydegger

(57) ABSTRACT

A sub-carriage includes a first head mounting portion and a second head mounting portion. The second head mounting portion includes at least a portion of constitution members of an adjustment mechanism which adjusts a position of the second head, a first recording head of one side of the same set is fixed in a state of being positioned to the first head mounting portion so that the nozzles are disposed in a defined position, and a second recording head of the other side is fixed to the second head mounting portion in a state where the relative position to the first recording head is defined by the adjustment mechanism based on a landing position in a recording medium of ink ejected from predetermined nozzles of the second recording head with respect to a landing position in a recording medium of ink ejected from predetermined nozzles of the first head.

6 Claims, 15 Drawing Sheets

LIQUID EJECTING HEAD UNIT AND MANUFACTURING METHOD THEREOF

The entire disclosure of Japanese Patent Application No: 2010-275423, filed Dec. 10, 2010 is expressly incorporated by reference herein.

BACKGROUND

1. Technical Field

The present invention relates to a liquid ejecting head unit which is used in a liquid ejecting apparatus such as an ink jet type recording apparatus and a manufacturing method thereof, and particularly, to a liquid ejecting head unit capable of mounting a plurality of liquid ejecting heads with highly positional accuracy and a manufacturing method thereof.

2. Related Art

A liquid ejecting apparatus includes a liquid ejecting head capable of ejecting liquid as a droplet, and various liquids are ejected from the liquid ejecting head. For example, as a representative of the liquid ejecting apparatuses, an image recording apparatus such as an ink jet type recording apparatus (printer) can be listed, in which an ink jet type recording head (hereinafter, referred to as a "recording head") is provided, a liquid ink is ejected as an ink droplet from a nozzle of the recording head, and the recording is performed. In addition, in recent years, the liquid ejecting apparatus has become not limited to the image recording apparatus and has been applied to various manufacturing apparatuses such as a display manufacturing apparatus.

In recent years, in the printer, a configuration has been adapted, in which a recording head including a nozzle group, which is constituted by installing nozzles in a plurality of rows, is fixed side by side in a plurality to a head fixing member such as a sub-carriage and configured as one head unit (for example, refer to JP-A-2008-273109). The sub-carriage is a frame-shaped member so that the portion of the sub-carriage to which a plurality of the recording heads is mounted is opened. In addition, each recording head is fixed to the sub-carriage through screw-fastening in a state of being positioned with respect to the sub-carriage.

Here, in the printer which is configured so as to perform a recording operation while relatively reciprocating the recording head and a recording medium, a configuration is suggested in which each recording head is mounted on the sub-carriage so that arrangement of ink colors assigned to each nozzle row of the recording head is a symmetric positional relationship in the same direction from a center in a juxtaposed direction of the recording head in the sub-carriage. In the above configuration, two recording heads including the nozzle row of the same color are provided as a set, each recording head constituting the set is disposed on the sub-carriage so as to be in a symmetric positional relationship in the same direction from the center of the juxtaposed direction of the head. By adopting the above-described configuration, a landing sequence of the ink of each color can be aligned with respect to the recording medium at a forward path and a return path.

If the landing sequences of the ink of each color are different from each other with respect to the recording medium in the reciprocation, color tones of a portion in which dots of different colors are overlapped are different in the reciprocation. For example, a color tone of a portion in which a cyan dot formerly formed and a magenta dot subsequently formed are overlapped and a color tone of a portion in which a magenta dot formerly formed and a cyan dot subsequently formed are overlapped are different from each other. Thereby, there is a concern that an adverse effect may occur in the image quality of the recording image or the like. On the other hand, according to the configuration, due to the fact that the landing sequence of the ink of each color is aligned with respect to the recording medium in the forward path and the return path, the sequence in which dots of different colors are overlapped is also aligned in the reciprocation, and therefore, deterioration of the image quality of the recording image or the like can be suppressed.

However, for example, in a configuration in which nozzles of a recording head are formed through plastic working by using a punch, inclination of a center axis of the nozzle with respect to a nozzle formation surface may occur. Even when the mounting position of the recording head with respect to the sub-carriage is adjusted and mounted so that the nozzle position of each recording head is disposed in a defined position, in a case where the inclination of the nozzle is different for each recording head, a flight direction of the ink also varies for each recording head. As a result, variation in the landing position of the ink with respect to a recording medium such as a recording sheet occurs, and there is a concern that image quality of a recording image or the like may deteriorate. In particular, as the above-described configuration, if variation of the landing position occurs in the recording heads which are symmetrically disposed to the sub-carriage and constitute a set of the same color, more serious adverse effect may occur in the image quality of the recording image or the like.

On the other hand, a method is considered in which the mounting position of the recording head is adjusted with respect to the sub-carriage so that ink is actually ejected from the nozzles of each recording head to the recording medium and the landing position of the ink corresponds to a landing position which is a design target. However, when compared to the method in which the mounting position of the recording head on the basis of the position of the nozzles is adjusted, the adjusting method needs many more adjusting times, and there is a problem in that a disadvantage from the standpoint of productivity occurs. From reasons similar to the above matters, time is needed even when the position of the recording head is readjusted due to after-service or the like, and the operating ratio is decreased.

In addition, the above problems are generated in not only an ink jet type recording apparatus on which the recording head ejecting ink is mounted but also other liquid ejecting head units adopting a configuration which fixes a plurality of liquid ejecting heads to a head fixing member and a liquid ejecting apparatus including the liquid ejecting head unit.

SUMMARY

An advantage of some aspects of the invention is to provide a liquid ejecting head unit and a manufacturing method thereof capable of mounting a plurality of liquid ejecting heads in a shorter time with highly positional accuracy.

According to an aspect of the invention, there is provided a liquid ejecting head unit including a liquid ejecting head having at least one of nozzle rows including a plurality of nozzles which ejects liquid and a head fixing member to which a plurality of the liquid ejecting heads is fixed in a state where the nozzle rows are arranged, disposed, and positioned, wherein two liquid ejecting heads having nozzle rows which eject liquid of the same color form a set as a first head and a second head, and at least two sets of each liquid ejecting head are fixed to the head fixing member so that a color arrangement of the liquids each assigned to each nozzle row is symmetrical in the same direction from a center of a juxtaposed direction of each liquid ejecting head, the head fixing member includes a first head mounting portion to which the first head is fixed and a second head mounting portion to which the second head is fixed, the second head mounting portion includes at least a portion of constitution members of an adjustment mechanism which adjusts a position of the second head disposed in the second head mounting portion, a first head of one side of the same set is fixed to the first head mounting portion in a state where the nozzles are positioned so as to be disposed in a defined position, and a second head of the other side of the same set is fixed to the second head mounting portion in a state where a relative position of the second head to the first head is defined by the adjustment mechanism based on a landing position in a landing target of liquid ejected from predetermined nozzles of the second head with respect to a landing position in a landing target of liquid ejected from predetermined nozzles of the first head.

According to the aspect of the invention, in one side of the first head which has the nozzle row of the same color and forms a set, the one side of first head is fixed in the state of being positioned with respect to the first head mounting portion of the head fixing member so that the target nozzles are disposed in the defined position. On the other hand, in the other side of the second head, based on the landing position in the landing target of the liquid which is ejected from predetermined nozzles of the second head with respect to the landing position in the landing target of the liquid which is ejected from predetermined nozzles of the first head which forms a set, the second recording head is fixed to the head fixing member in the state where the relative position of the second head with respect to the first head is defined by the adjustment mechanism. Therefore, particularly, the positional relationship of the liquid ejecting heads of the same set having the nozzle row of the same color ejecting the liquid is secured with higher accuracy. That is, since the relative position of the liquid ejecting heads of the same set is defined based on an actual liquid landing position, inherent characteristics of every liquid ejecting head such as the inclination of the nozzles to the nozzle formation surface are reflected in the positional relationship of the liquid ejecting heads of the same set. In addition, in the configuration which includes the set of the liquid ejecting head having the nozzle rows of the same color, the landing position deviation between the liquids of the same color can be prevented. Thereby, when an image or the like is recorded with respect to the landing target, deterioration of image quality of a recording image or the like due to the landing position deviation can be suppressed.

Moreover, compared to the position adjustment method based on the position of the nozzles, the position adjustment method based on the actual landing position on the landing target of the liquid which is ejected from the nozzles needs more adjusting time. However, since the latter position adjustment method having relatively short adjusting time is adopted to one side of the first head forming a set, with regard to the entire liquid ejecting head, the overall adjusting time can be shortened compared to the case in which the former position adjusting method is adopted. As a result, decrease in the productivity or the like can be suppressed.

In the liquid ejecting head unit, the adjustment mechanism may include a biasing member which biases to one side of a head juxtaposed direction of a partition wall which partitions the second head mounting portion and to one side of directions perpendicular to the head juxtaposed direction respectively, a biasing member mounting portion on which the biasing member is mounted, a first adjustment member which adjusts a position in a direction perpendicular to the head juxtaposed direction of the second head disposed on the second head mounting portion in a state of being biased by the biasing member, and a second adjustment member which adjusts an inclination in a nozzle formation surface direction of the second head.

In addition, in the liquid ejecting head unit, one of the first heads of each set may be fixed as a reference head with respect to the first head mounting portion, and other remaining first heads may be fixed to the first head mounting portions in a state where the relative positions with respect to the reference head are defined.

Moreover, in the liquid ejecting head unit, the reference head may be fixed in a state of being positioned by a positioning pin with respect to the first head mounting portion.

According to the liquid ejecting head units, the position adjustment of the reference head with respect to the first head mounting portion is simply and rapidly completed by using the positioning pin, which can contribute to the foreshortening of the adjustment time.

According to another aspect of the invention, there is provided a manufacturing method of a liquid ejecting head unit which includes a liquid ejecting head having at least one of nozzle rows including a plurality of nozzles which ejects liquid and a head fixing member to which a plurality of the liquid ejecting heads is fixed in a state where the nozzle rows are arranged, disposed, and positioned, and in which two liquid ejecting heads having nozzle rows which eject liquid of the same color form a set as a first head and a second head, and at least two sets of each liquid ejecting head are fixed to the head fixing member so that a color arrangement of the liquids each assigned to each nozzle row is symmetrical in the same direction from a center of a juxtaposed direction of each liquid ejecting head, the manufacturing method including adjusting a mounting position of a first head of one side of the same set with respect to a first head mounting portion of the head fixing member so that predetermined nozzles are disposed in a defined position, fixing the first head to the first head mounting portion in a state where the mounting position of the first head is defined by the adjusting of the mounting position, adjusting the relative position of the second head with respect to the first head by the adjustment mechanism based on a landing position in a landing target of liquid ejected from predetermined nozzles of a second head of the other side of the same set with respect to a landing position in a landing target of liquid ejected from predetermined nozzles of a first head of one side of the same set, and fixing the second head to a second head mounting portion of the head fixing member in a state where the mounting position of the second head is defined by the adjusting of the relative position.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments according to the invention will be described with reference to the accompanying drawings. In addition, the embodiments described below are preferably specified examples and variously limited. However, the range of the invention is not limited to the embodiments unless the gist in which the invention is particularly limited is described in the description below. Moreover, in the description below, an ink jet type recording apparatus (hereinafter, referred to as a "printer") is described as an example of a liquid ejecting apparatus.

Figure 1:
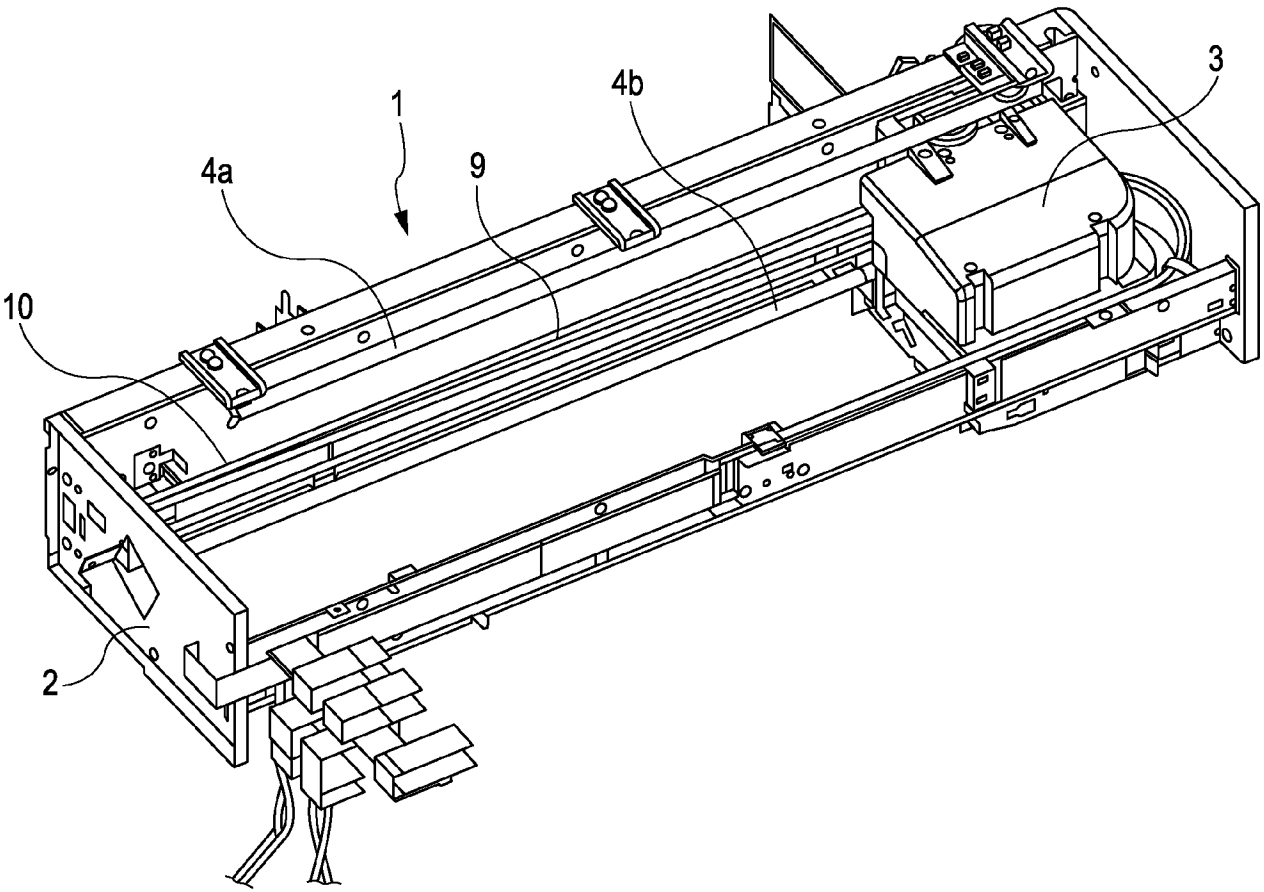
FIG. 1 is a perspective view showing a portion of an inner configuration of a printer.
Figure 2:
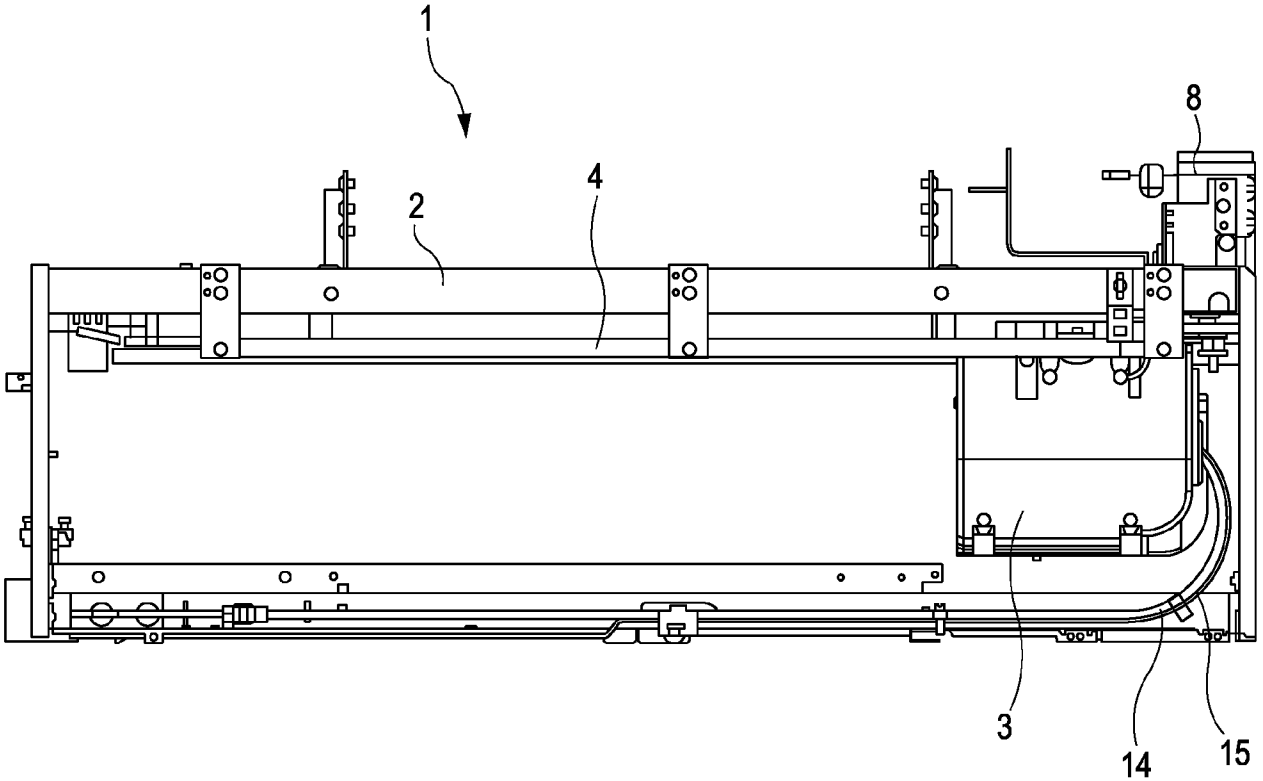
FIG. 2 is a plan view of the printer.

FIG. 1 is a perspective view showing a portion of an inner configuration of a printer 1, and FIG. 2 is a plan view of the printer 1. The illustrated printer 1 ejects ink which is a kind of liquid toward a recording medium (a target on which to be landed) such as a recording sheet or a film. The printer 1 mounts a carriage assembly 3 (a kind of a head unit holding member) so as to be reciprocated in a main scanning direction, which is a direction perpendicular to a transporting direction of the recording medium, in an inner portion of a frame 2. A pair of upper and lower guide rods 4*a* and 4*b* which are elongated along a longitudinal direction of the frame 2 is mounted on the inner wall of the frame 2 of the rear surface side of the printer 1 so as to be parallel and apart from each other. Due to the fact that the guide rods 4*a* and 4*b* are fitted to a bearing portion 7 (refer to FIG. 4) or the like which is installed on a rear surface side of a carriage assembly 3, the carriage assembly 3 is slidably supported to the guide rods 4*a* and 4*b*.

A carriage motor 8 which is a driving source for moving the carriage assembly 3 is disposed on one end side (the right end in FIG. 3) of the main scanning direction in the rear surface side of the frame 2. A driving shaft of the carriage motor 8 is protruded from the rear surface side of the frame 2 to the inner surface side thereof, and the tip portion of the driving shaft is connected to a driving pulley (not shown). The driving pulley is rotated by the driving of the carriage motor 8. An idle pulley (not shown) is installed on a position (the left end in FIG. 2) which is an opposite side in the main scanning direction with respect to the driving pulley. A timing belt 9 spans and is passed to the driving pulley and the idle pulley. The carriage assembly 3 is connected to the timing belt 9. In addition, if the carriage motor 8 is driven, the timing belt 9 is rotated according to the rotation of the driving pulley, and the carriage assembly 3 moves in the main scanning direction along the guide rods 4*a* and 4*b*.

A linear scale 10 (encoder film) is extended and installed to the inner wall of the rear surface of the frame 2 so as to be parallel to the guide rods 4*a* and 4*b* along the main scanning direction. The linear scale 10 is a band-shaped member which is manufactured of a transparent resin film, and for example, in which a plurality of opaque stripes across the band width direction on a surface of a transparent base film is printed. Each stripe is constituted as the same width, and is formed by a constant pitch in the longitudinal direction of the band. In addition, a linear encoder (not shown) for optically reading the stripe of the linear scale 10 is installed on the rear surface side of the carriage assembly 3. For example, the linear encoder includes a pair of a light emitting element and a light receiving element which are disposed so as be opposite to each other, and outputs an encoder pulse according to the difference between the light receiving state in the transparent portion and the light receiving state in the stripe portion in the linear scale 10. That is, the linear encoder is a kind of a position information output section, and outputs the encoder pulse according to the scanning direction of the carriage assembly 3 as the position information in the main scanning direction. Thereby, a control portion (not shown) of the printer can control the recording operation with respect to the recording medium by a head unit 17 while recognizing the scanning position of the carriage assembly 3 based on the encoder pulse from the linear encoder. Moreover, the printer 1 is constituted so that a so-called bi-directional recording process is performed, that is, characters or images and the like are recorded on the recording sheet in both directions at a time of a forward movement in which the carriage assembly 3 moves from a home position in the one end side of the main scanning direction toward the end of the opposite side (full position) and at a time of a return movement in which the carriage assembly 3 returns from the full position to the home position side.

As shown in FIG. 2, an ink supply tube 14 for supplying the ink of each color to each recording head 18 of the head unit 17 and a signal cable 15 for supplying signals such as a driving signal are connected to the carriage assembly 3. Except for that, although not shown, a cartridge mounting portion on which an ink cartridge (liquid supply source) for storing ink is detachably mounted, a transporting portion which transports the recording sheet, and a capping portion for capping a nozzle formation surface of the recording head 18 in a stand-by state, or the like are installed on the printer 1.

Figure 3:
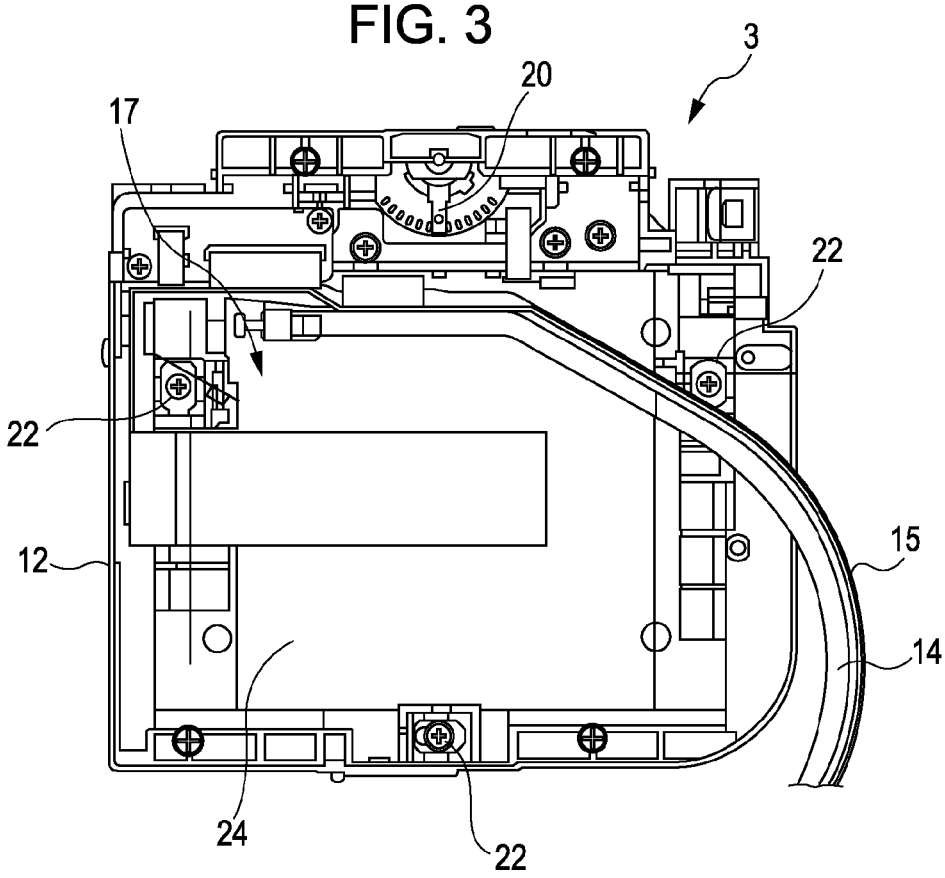
FIG. 3 is a plan view of a carriage assembly.
Figure 4:
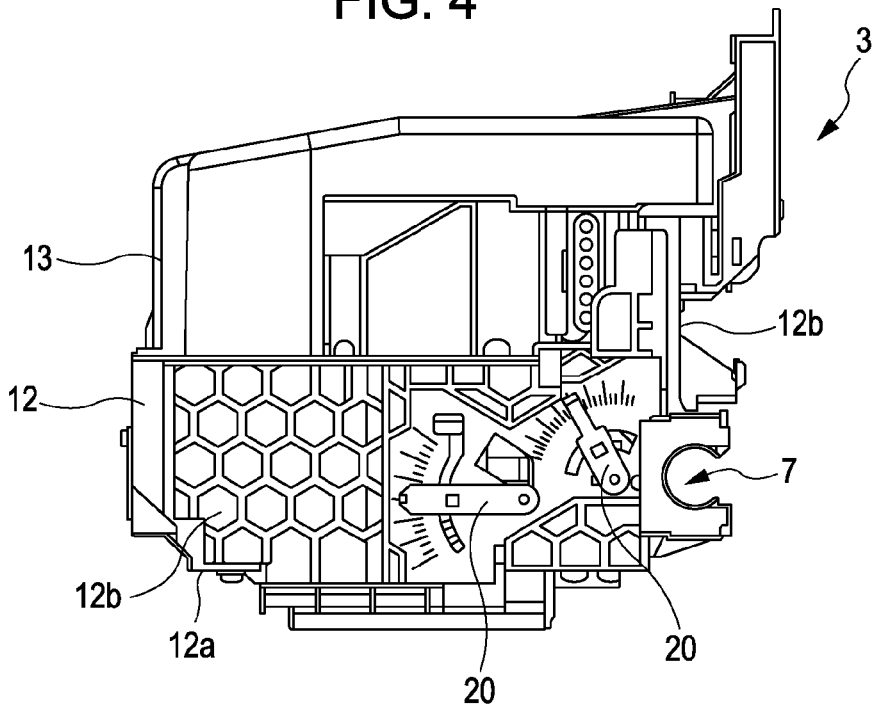
FIG. 4 is a right-side view of the carriage assembly.

FIG. 3 is a plan (top) view of the carriage assembly 3, and FIG. 4 is a right-side view of the carriage assembly 3. In addition, FIG. 3 shows a state where a carriage cover 13 is removed. The carriage assembly 3 includes a carriage body 12 on which the head unit 17 described below is mounted (a kind of a liquid ejecting head unit in the invention) therein and a capping cover 13 which closes an upper opening of the carriage body 12, and is a hollow box-shaped member capable of being divided into upper and lower portions. The carriage body 12 includes a bottom plate portion 12*a* having an approximately rectangular shape and a side wall portion 12*b* which is erected upward from outer peripheral edges on all sides of the bottom plate portion 12*a* respectively, and the head unit 17 is accommodated in a space which is surrounded by the bottom plate portion 12*a* and the side wall portion 12*b*. A bottom opening (not shown) is provided so as to be opened in the bottom plate portion 12*a* in order to expose a nozzle formation surface 53 of each recording head 18 of the accommodated head unit 17. In addition, in the state where the head unit 17 is accommodated in the carriage body 12, the nozzle formation surface 53 of each recording head 18 is protruded lower (recording medium side at the time of recording operation) than the bottom portion of the carriage body 12 from the bottom opening of the bottom plate portion 12*a*.

A plurality of eccentric cams (not shown) for adjusting the posture of the head unit 17 accommodated in the carriage body 12 is installed between the carriage body 12 and the head unit 17. In addition, a plurality of adjusting levers 20 for rotating the eccentric cams is installed in the carriage body 12. By operation of the adjusting levers 20, the eccentric cam is rotated and a diameter of the cam is increased or decreased from the rotation center to the outer periphery. Therefore, the postures such as the position or the inclination of the head unit 17 (sub-carriage 26) accommodated in the carriage body 12 can be adjusted with respect to the carriage body 12 through the increase and the decrease of the cam diameter.

Figure 5:
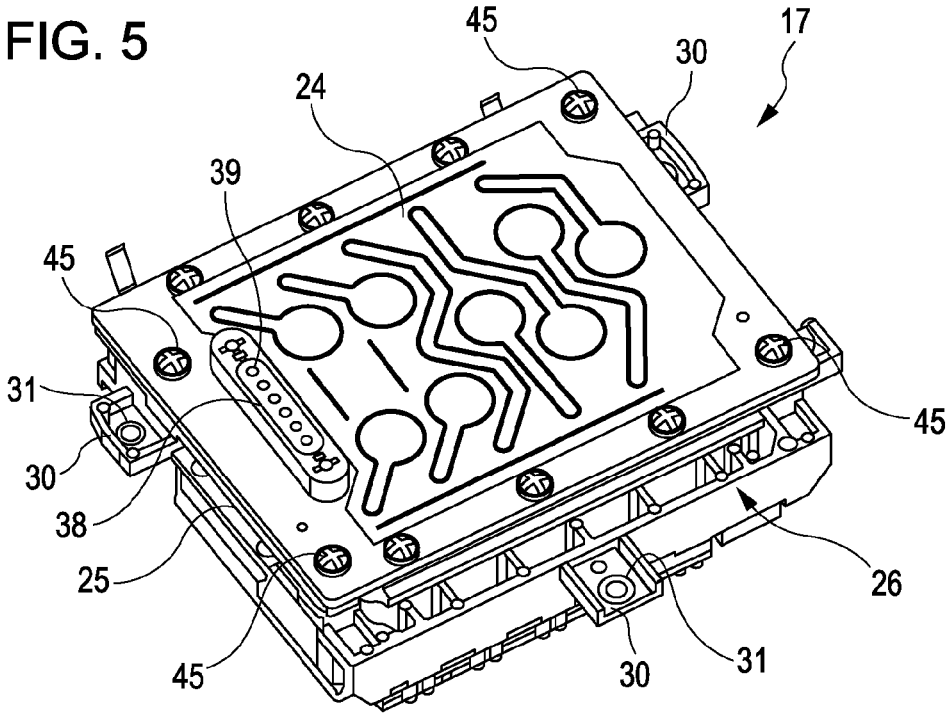
FIG. 5 is a perspective view of a head unit.
Figure 6:
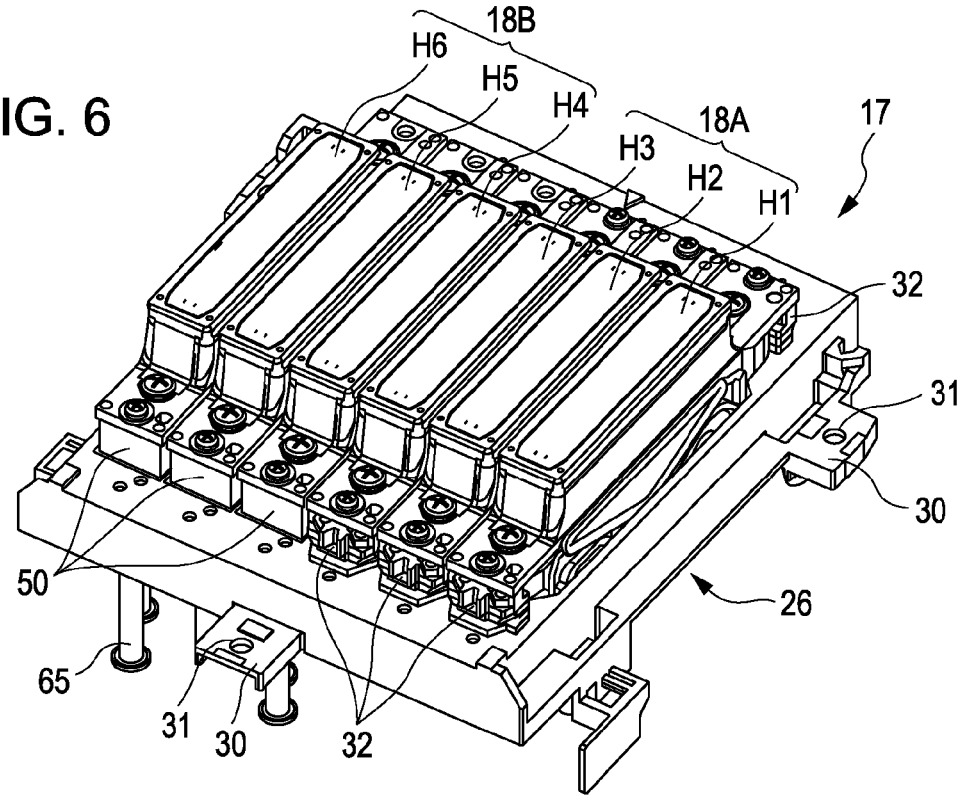
FIG. 6 is a perspective view of the bottom side of the head unit.
Figure 7:
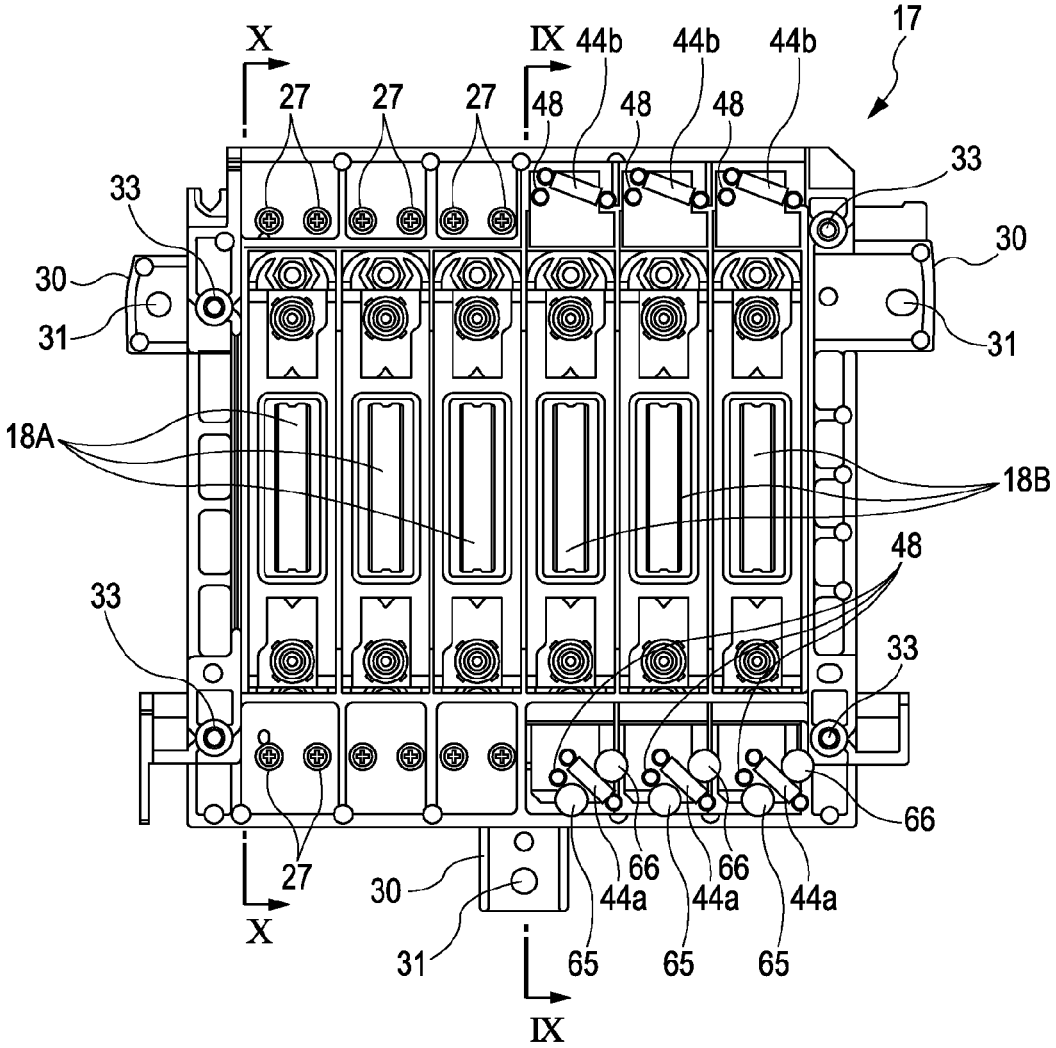
FIG. 7 is a plan view of the head unit in a state where a flow channel member is removed.
Figure 8:
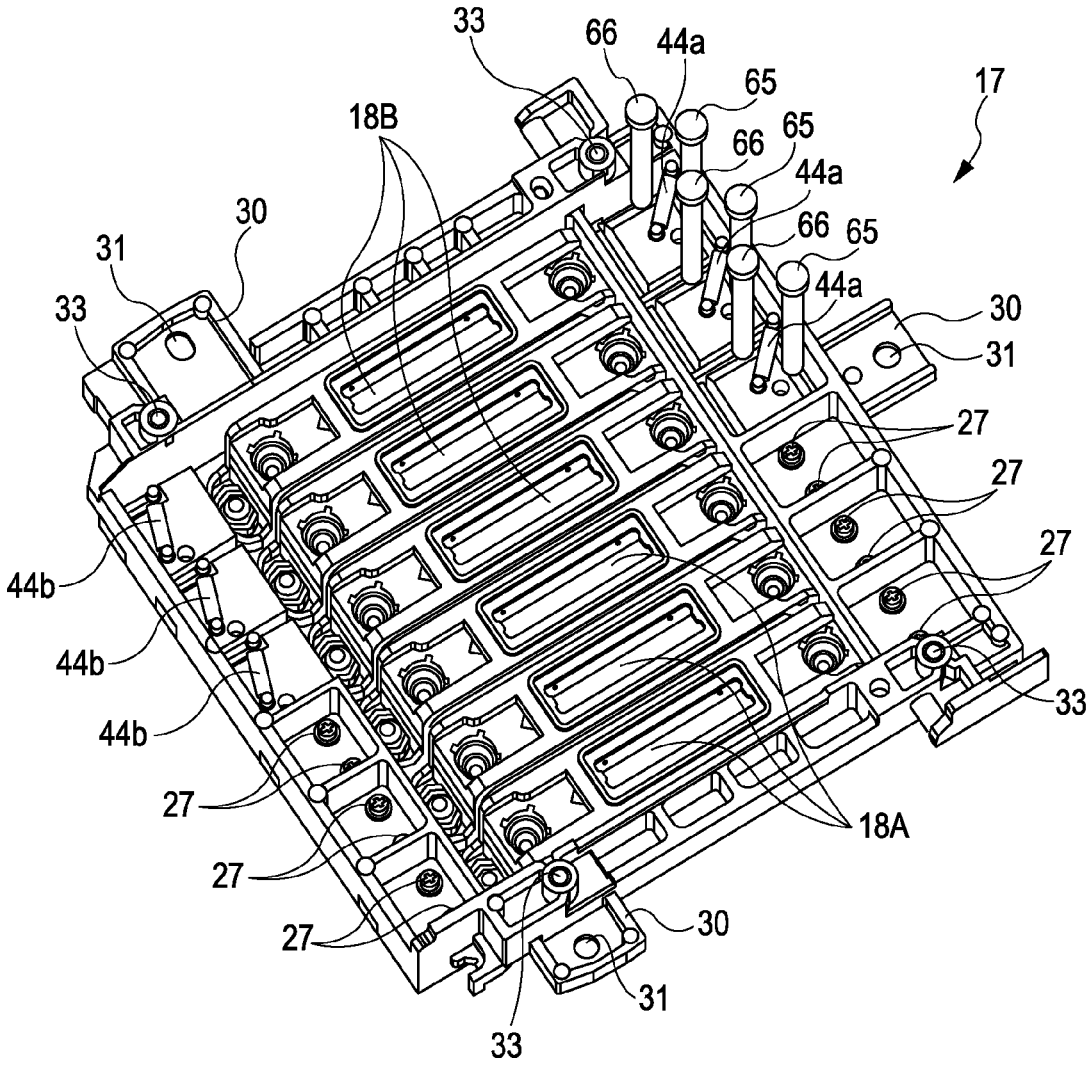
FIG. 8 is a perspective view of the head unit in the state where the flow channel member is removed.
Figure 9:
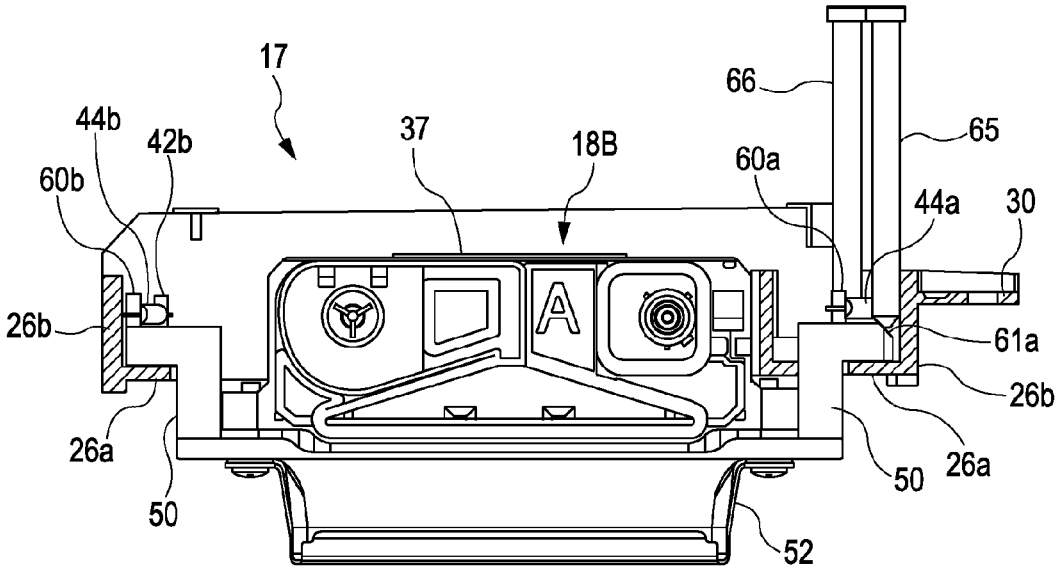
FIG. 9 is a cross-sectional view taken along IX-IX of FIG. 7.
Figure 10:
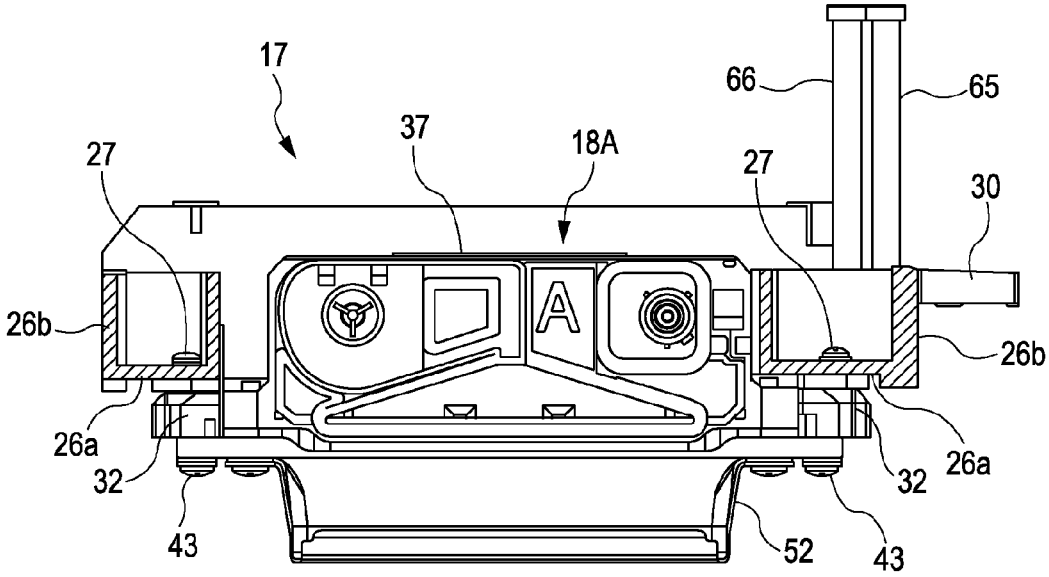
FIG. 10 is a cross-sectional view taken along X-X of FIG. 7.
Figure 11A:
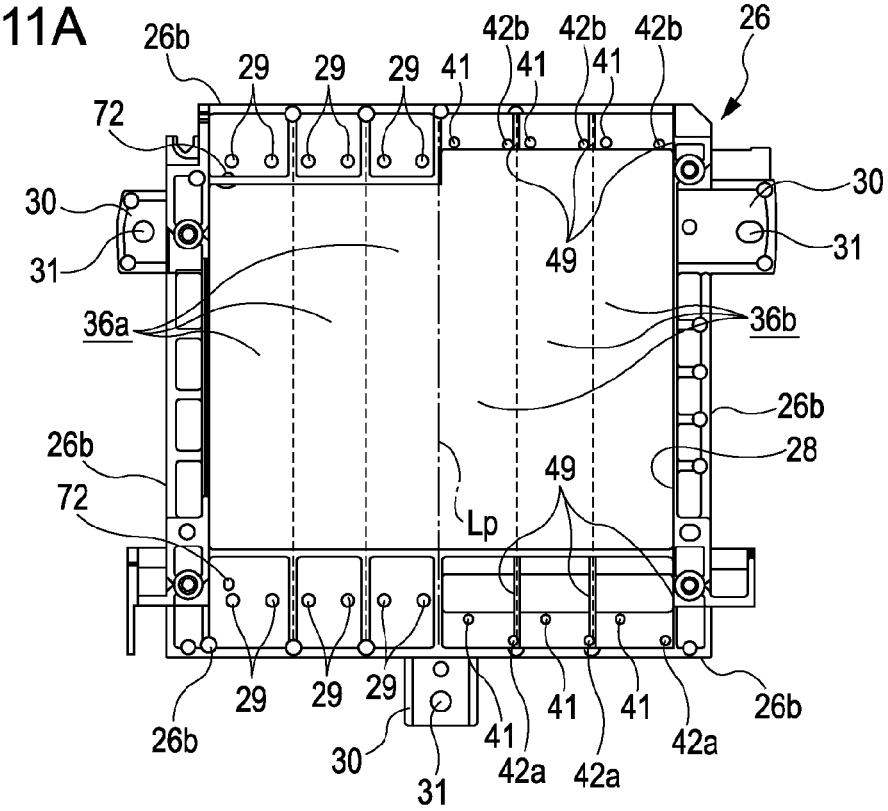
FIGS. 11A and 11B are views illustrating configuration of the sub-carriage.
Figure 11B:
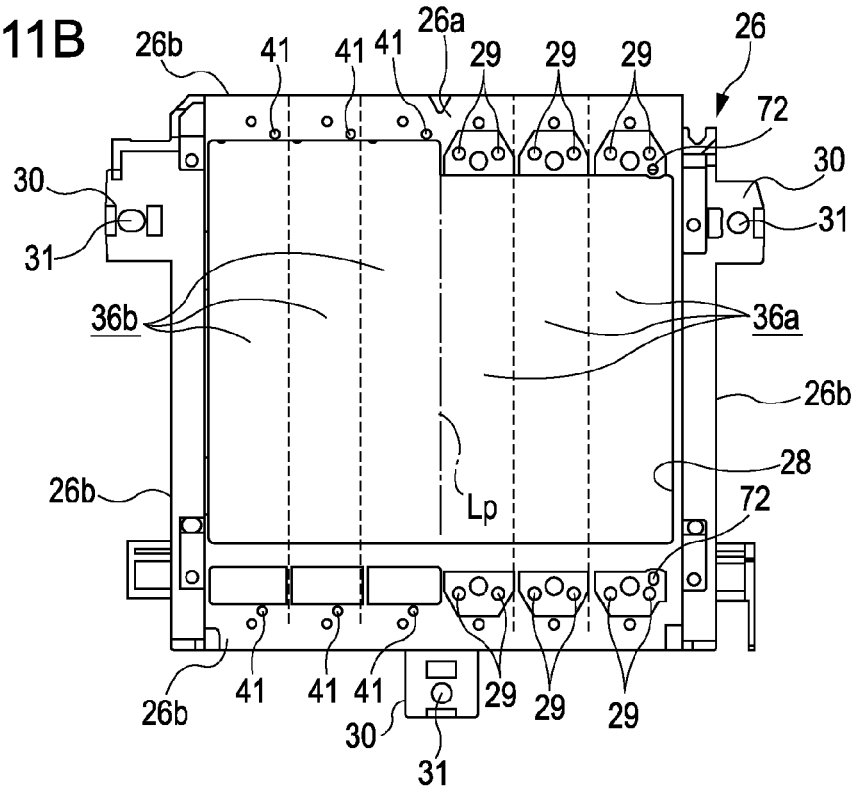

FIG. 5 is a perspective view of the head unit 17, and FIG. 6 is a perspective view when viewing from the lower surface (nozzle formation surface) side of the head unit 17. In addition, FIG. 7 is a plan view (top view) of the head unit 17 in a state where a flow channel member 24 is not mounted, and FIG. 8 is a perspective view of the head unit 17 in the above state. Moreover, FIG. 9 is a cross-sectional view taken along IX-IX of FIG. 7, and FIG. 10 is a cross-sectional view taken along X-X of FIG. 7. Further, FIG. 11A is a top view illustrating configuration of the sub-carriage, and FIG. 11B is a bottom view illustrating the configuration of the sub-carriage.

The head unit 17 is constituted by unitizing a plurality of recording heads 18 or the like, and includes a sub-carriage 26 (a kind of head fixing member in the invention) on which the recording heads 18 are mounted and the flow channel member 24. The sub-carriage 26 includes a frame-shaped base portion 26*a* to which the recording head 18 is fixed and an erected wall portion 26*b* which is erected upward from the outer peripheral edge on all sides of the base portion 26*a* respectively, and is formed in a hollow box shape in which the upper surface is opened from the base portion 26*a* and the erected wall portion 26*b*. A space, which is surrounded by the base portion 26*a* and the erected wall portion 26*b* on all sides, functions as a receiving portion which receives at least a portion (mainly, sub-tank 37) of the recording head 18. The sub-carriage 26 of the present embodiment is manufactured of metal, for example, aluminum, and therefore, the strength is greater than that of the sub-carriage formed of synthetic resin.

A head through-opening 28 in which a plurality of recording heads 18 can be inserted is provided so as to be opened in an approximately center portion of the base portion 26*a*. Thereby, the base portion 26*a* becomes a frame-shaped body. The head through-opening 28 is an opening which is communicated with the receiving portion. Here, a total of six recording heads 18 are mounted on the sub-carriage 26 in the embodiment. In addition, the recording heads 18 are classified into two kinds of a first recording head 18A (corresponding to first head) and a second recording head 18B (corresponding to second head) according to a position adjusting method when the recording heads 18 are fixed to the sub-carriage 26. Moreover, as shown in FIGS. 11A and 11B, a total of three first head mounting portions 36*a* are partitioned and formed by the erected wall portion 26*b* which is a partition wall and a partition wall 49 in one side half (left half in FIG. 11A) from an imaginary partition line Lp of a center in a head juxtaposed direction in the sub-carriage 26. In each first head mounting portion 36*a*, three first recording heads 18A are mounted side by side in a direction perpendicular to a direction of a nozzle row in a state where spacers 32 are each interposed between the recording heads 18A and the base portion 26*a*. In addition, a total of three second head mounting portions 36*b* of the remaining half (right half in FIG. 11A) is partitioned and formed by the erected wall 26*b* which is the partition wall and the partition wall 49. In the second head mounting portion 36*b*, three second recording heads 18B are mounted side by side in the direction perpendicular to the direction of the nozzle row in a state where adjustment blocks 50 are each interposed between the recording heads 18B and the base portion 26*a*. Moreover, the position adjusting method of each recording head 18 will be described in detail below.

Fixing holes 29 are each provided so as to be opened in positions which correspond to each first head mounting portion 36*a* in the lower surface (the surface which is the side opposite to the recording medium when the recording is performed) of the base portion 26*a*. The fixing hole 29 is a through-hole in which a shaft portion of a spacer fixing screw 27 described below is inserted. In the embodiment, with respect to the mounting position of one recording head 18, the fixing holes 29 are installed in a total of four positions with each two corresponding to a through-hole 32" for the sub-carriage of the spacer 32 described below in both sides in the direction corresponding to the nozzle row direction while interposing the head through-opening 28. In addition, positioning holes 72 (refer to FIG. 11B) are each installed in the vicinity of the fixing hole 29 in the head mounting portion (the position on which the recording head H1 of the first recording head 18A is mounted) of the end of the first head mounting portion 36*a*. The positioning holes 72 will be described hereinafter.

Positioning holes 41 and spring fixing pins 42 are each erected in the positions corresponding to each second head mounting portion 36*b* in the upper surface (bottom surface of the head receiving portion) of the base portion 26*a*. The positioning holes 41 are a through-hole in which a positioning pin of a tool is inserted so as to define a rough position of the second recording head 18B with respect to the sub-carriage 26 in a state where the position of the second recording head 18B is matched with the position of the positioning hole 48 provided to be opened to the adjustment block 50 of the second recording head 18B when the second recording head 18B is positioned with respect to the sub-carriage 26. With respect to the mounting position of one second recording head 18B, the positioning holes 41 are installed in a total of two positions for each one in both sides in the direction (the direction perpendicular to the head juxtaposed direction) corresponding to the nozzle row direction while interposing the head through-opening 28. In addition, the spring fixing pins 42 (a kind of a biasing member mounting member) are a pin for spanning and passing a biasing spring 44 (44*a* and 44*b*) which is a kind of a biasing member between the spring fixing pins 42 and the spring fixing pins 60 (60*a* and 60*b*) installed on the adjustment block 50 of the second recording head 18B. In the embodiment, with respect to one second head mounting portion 36*b*, the spring fixing pin 42 are installed in a total of two positions for each one in both sides in the direction corresponding to the nozzle row direction while interposing the head through-opening 28. Here, in the spring fixing pin 42 of both sides in the nozzle row direction, one side (the lower side in FIG. 11A) of the spring fixing pin 42 becomes a first spring fixing pin 42*a*, and the other side (the upper side in FIG. 11A) of the spring fixing pin 42 becomes a second spring fixing pin 42*b*. The spring fixing pins 42*a* and 42*b* are each erected in the vicinity of a partition wall 49 which is a side (one side) opposite to the first head mounting portion 36*a* in the head juxtaposed direction between partition walls 49 of both sides in the head juxtaposed direction which partitions the second head mounting portion 36*b*. In addition, the first spring fixing pin 42*a* is erected in the vicinity (a corner portion which is formed by the partition wall 49 and the erected wall portion 26*b*) of the one side of erected wall portion 26*b* in the nozzle row direction among the erected wall portion 26*b* which partitions the second head mounting portion 36*b*.

Ear-shaped flange portions 30 are protruded toward the side in three erected wall portions among the erected wall portions 26*b* on all sides of the sub-carriage 26. In the flange portion 30, through-holes 31 are each installed corresponding to mounting screw holes (not shown) of three positions which are provided so as to be opened to the mounting position of the head unit 17 of the bottom plate portion 12*a* in the carriage body 12. Due to the fact that a head unit fixing screw 22 (refer to FIG. 3) is passed to the through-hole 31 and fixed to the mounting screw hole in a state where the position of each through-hole 31 corresponding to each mounting screw hole of the bottom plate portion 12*a* of the carriage body 12 is matched, the head unit 17 is received and fixed to the inner portion of the carriage body 12. In addition, as described above, in the step before the main fixing of the head unit 17 with respect to the carriage body 12 is performed, postures such as position or inclination of the head unit 17 are adjusted with respect to the carriage body 12 by operation of the above-described adjustment lever 20. Moreover, a fixing screw hole 33 is installed in a total of four positions on the upper end surface of the erected wall portions 26*b* on all sides of the sub-carriage 26 in order to fix the flow channel member 24.

In the inner portion of the flow channel member 24, and an ink distribution flow channel of each color (not shown) corresponding to a flow channel connecting portion 38 of a sub-tank 37 (described below) of each recording head 18 is partitioned and formed. As shown in FIG. 5, a tube connecting portion 34 is installed in the upper surface (the surface of the side which is opposite to the surface of the side which is fixed to the sub-carriage 26) of the flow channel member 24. A plurality of introducing ports 39 corresponding to ink of each color is installed in the inner portion of the tube connecting portion 34. Each introducing port 39 is communicated with the ink distribution flow channel of each corresponding color. In addition, if the ink supply tube 14 is connected to the tube connecting portion 34, the ink supply passage of each color in the ink supply tube 14 and each corresponding introducing port 39 are communicated with each other in a liquid tight state. Thereby, the ink of each color which is fed through the ink supply tube 14 from the ink cartridge side is introduced to the ink distribution flow channel in the flow channel member 24 through the introducing port 39 respectively. The ink passing though each ink distribution flow channel flows into the sub-tank 37 of each recording head 18 through the flow channel connecting portion 38. In four corners of the flow channel member 24, flow channel through-holes (not shown) corresponding to the fixing screw hole 33 of the sub-carriage 26 are each formed in the state of penetrating the thickness direction of the plate. When the flow channel member 24 is fixed to the sub-carriage 26, flow channel fixing screws 45 are fixed (screwed) to the fixing screw holes 33 through the flow channel through-holes.

Figure 12:
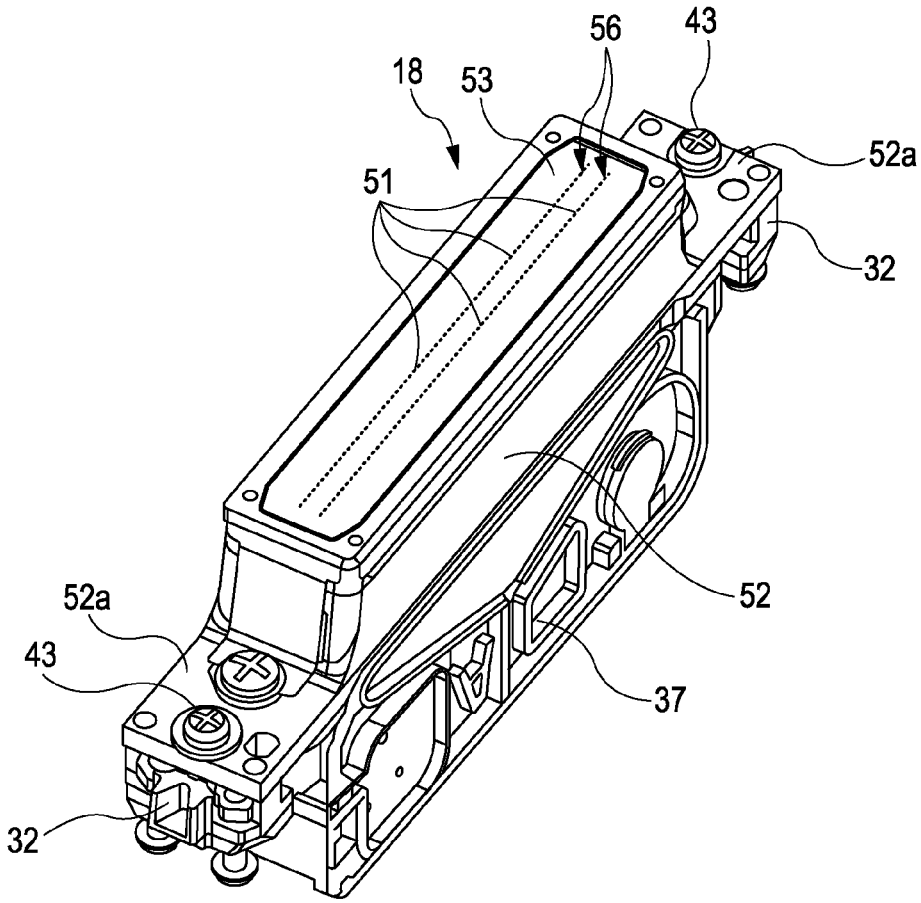
FIG. 12 is a perspective view of a side of a nozzle formation surface of the recording head.
Figure 13A:
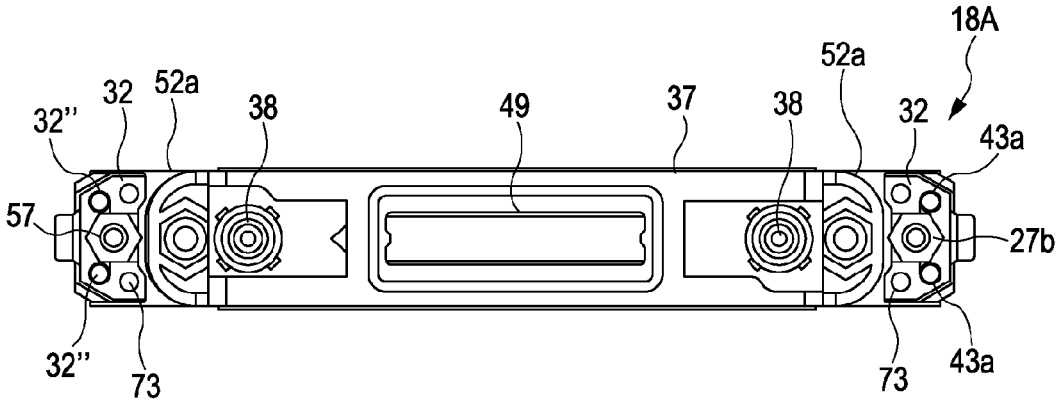
FIGS. 13A and 13B are views illustrating a first recording head.
Figure 13B:
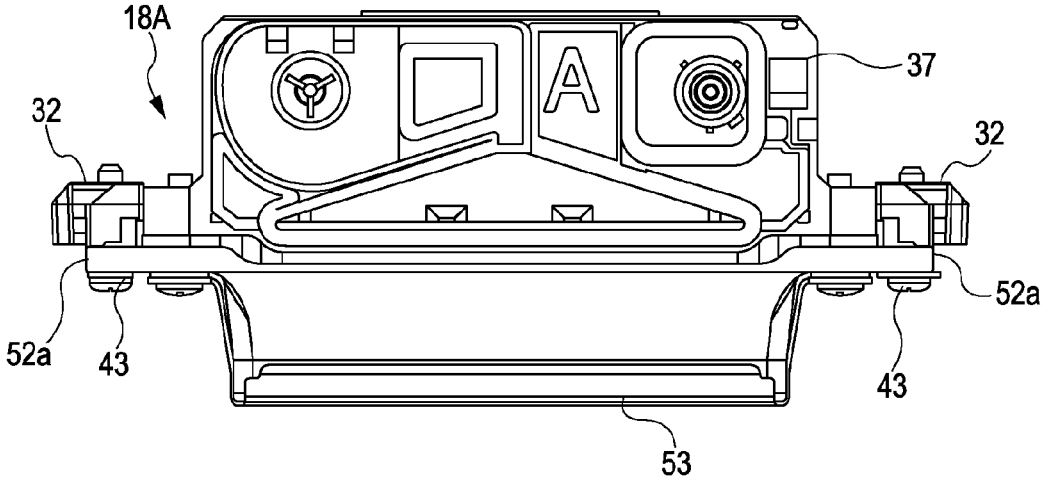
Figure 14A:
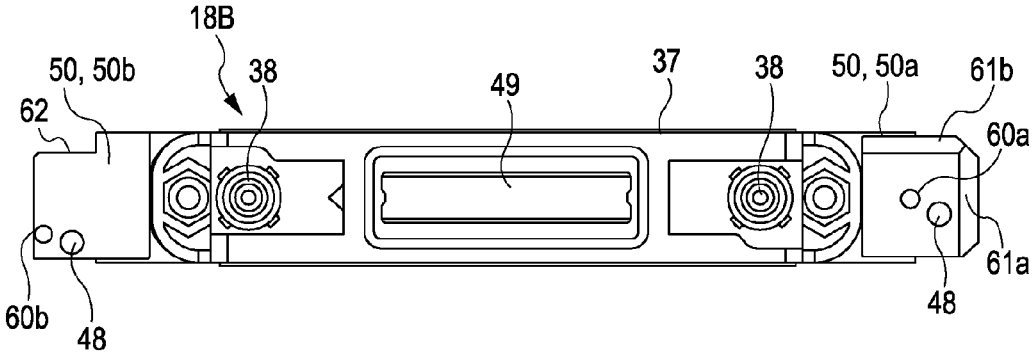
FIGS. 14A and 14B are views illustrating a second recording head.
Figure 14B:
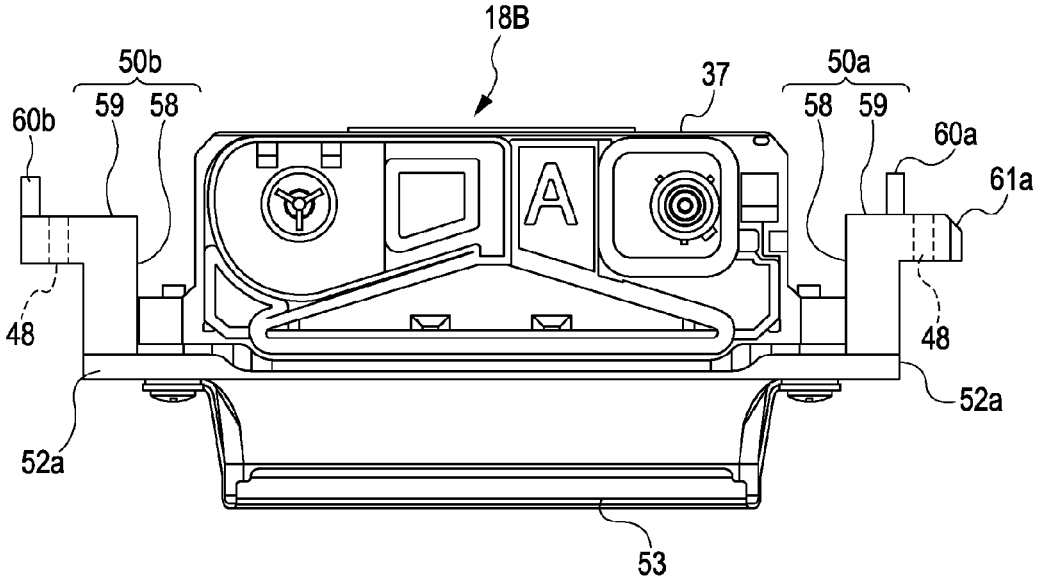

FIG. 12 is a perspective view illustrating the configuration of the recording head 18 (a kind of liquid ejecting head). FIGS. 13A and 13B are views illustrating the configuration of the first recording head 18A, FIG. 13A is a plan view thereof, and FIG. 13B is a side view thereof. In addition, FIGS. 14A and 14B are views illustrating the configuration of the second recording head 18B, FIG. 14A is a plan view thereof, and FIG. 14B is a side view thereof.

A head case 52 of a main body of the recording head 18 includes a flow channel unit which forms an ink flow channel including a pressure chamber communicating with nozzles 51 or a pressure generating portion (any one is not shown) such as a piezoelectric vibrator or a heater element which generates a pressure variation in the ink within the pressure chamber. Due to the fact that a driving signal from the control portion side of the printer 1 is applied to the pressure generating portion and the pressure generating portion is driven, the recording head 18 ejects the ink from the nozzles 51, lands the ink on the recording medium such as recording sheet, and performs the recording operation. In the nozzle formation surface 53 of each recording head 18, nozzles 51 ejecting the ink are installed in a plurality of rows and nozzle rows 56 are constituted, and in the embodiment, the nozzle rows 56 are formed side by side in two rows in the direction perpendicular to the nozzle row. For example, one nozzle row 56 includes nozzle openings provided in the number of 360 at a 360 dpi pitch. The ink flow channel or the pressure generating portion or the like corresponding to each nozzle row 56 is each installed independently, and as described hereinafter, different inks are each assigned to two nozzle rows 56 of the same recording head 18.

The head case 52 is a hollow box-shaped member, and the flow channel unit is fixed to the tip side of the head case in the state where the nozzle formation surface 53 is exposed. Moreover, the pressure generating portion and the like are accommodated in a receiving space formed in the inner portion of the head case 52, and the sub-tank 37 for supplying the ink to the flow channel unit side is mounted on the base surface side (upper surface side) which is side opposite to the tip surface. In addition, flange portions 52*a* protruded toward the side of the head case 52 are each formed in both sides in the nozzle row direction in the upper surface side of the head case 52. In the flange portions 52*a*, mounting holes 54 are each provided so as to be opened corresponding to the through-hole 32' for a head of the spacer 32 (refer to FIG. 15) or the through-hole for attaching the adjustment block 50.

The spacer 32 mounted on the flange portion 52*a* of the first recording head 18A is formed of synthetic resin, and a total of two spacers 32 for each one are mounted on the upper surface (the surface of the sub-tank 37 side) of both sides of flange portions 52*a* with respect to one first recording head 18A. The through-hole 32' (refer to FIG. 15) for a head corresponding to the mounting hole 54 of the recording head 18 is formed in the center portion of a width direction (direction which is perpendicular to the nozzle row in the state where the spacer 32 is mounted on the recording head 18) of the spacer 32. In addition, FIGS. 13A and 13B show a state where a shaft portion of a spacer fixing screw 43 is inserted to the mounting hole 54 and the through-hole 32' for the head from the lower surface side of the flange portion 52*a*, a nut 57 is screwed to the tip of the shaft portion, and the spacer 32 is screwed to the flange portion 52*a*. Moreover, two positioning holes are provided so as to be opened in the spacer 32 in the state of penetrating the thickness direction of the spacer 32. One positioning hole 73 of these is installed corresponding to the positioning hole 72 of the sub-carriage 26, and is a through-hole to which a positioning pin of a tool is inserted when the recording head H1 of the first recording head 18A is positioned with respect to the sub-carriage 26.

In addition, through-holes 32" for the sub-carriage are each provided so as to be opened in both ends in the width direction of the spacer 32 corresponding to the fixing hole 29 installed on the base portion 26*a* of the sub-carriage 26. That is, one through-hole 32' for the head and two through-holes 32" for the sub-carriage are installed in each spacer 32. In a step before the first recording head 18A is mounted on the sub-carriage 26, the spacers 32 are each fastened to both sides of flange portion 52*a* of the first recording head 18A by the spacer fixing screw 43. As described below, after the spacer 32 is temporarily fixed to the sub-carriage 26 by adhesive agent, the spacer 32 is finally fixed by the spacer fixing screw 27. In the recording head 18 which is once fixed to the sub-carriage 26, the spacer 32 and the sub-carriage 26 can be removed by releasing the fastening of the spacer fixing screw 43 between the recording head 18 and the spacer 32. Thereby, the attachment and detachment of the recording head 18 due to the exchange or the repair and the like of the recording head 18 can be easily performed.

Similarly to the spacer 32, the adjustment blocks 50 each mounted on both sides of flange portions 52*a* of the second recording head 18B are formed of synthetic resin, and a total of two spacers 32 for each one are mounted on the upper surface (the surface of the sub-tank 37 side) of both sides of flange portions 52*a* with respect to one second recording head 18B. Here, the adjustment block 50 which is mounted on the flange portion 52*a* of one side (right side in FIGS. 14A and 14B) of the second recording head 18B is a first adjustment block 50*a*, and the adjustment block 50 which is mounted on the flange portion 52*a* of the other side (left side in FIGS. 14A and 14B) of the second recording head 18B is a second adjustment block 50*b*. The adjustment blocks 50*a* and 50*b* are a member which includes a rectangular parallelepiped-shaped block main body portion 58 erected with respect to the upper surface of the flange portion 52*a*, and a block flange portion 59 which is approximately rectangular extended toward the side direction (the side which is opposite to the sub-tank 37 side in the state of being mounted on the flange portion 52*a*) from the upper end of the block main body portion 58.

A first spring fixing pin 60*a* (a kind of biasing member mounting portion) is erected in an approximately center portion of the upper surface of the block flange portion 59 of the first adjustment block 50*a*. The first spring fixing pin 60*a* is a pin for spanning and passing the first biasing spring 44*a* (refer to FIG. 7) between the first spring fixing pin 60*a* and the first spring fixing pin 42*a* installed on the sub-carriage 26. In addition, in the block flange portion 59, the positioning hole 48 is provided so as to be opened in a state of penetrating the thickness direction of the block flange portion 59 at a position which is deviated from the first spring fixing pin 60*a*. The positioning hole 48 is installed corresponding to the positioning hole 41 of the sub-carriage 26, and is a through-hole to which a positioning pin of a tool is inserted when the second recording head 18B is positioned with respect to the sub-carriage 26.

Moreover, in the periphery of the boundary between the upper surface of the block flange portion 59 and the protruded end surface of the block flange portion 59, a chamfered portion 61*a* is formed so as to be inclined with respect to the upper surface of the block flange portion 59 when viewing laterally. In the embodiment, the inclined angle of the chamfered portion 61*a* with respect to the upper surface of the block flange portion 59 is 45°. As described below, the chamfered portion 61*a* is a surface on which a tapered surface 67 of a tip of a Y-direction adjustment pin 65 slides when a Y-direction adjustment of the second recording head 18B is performed in a state where the second recording head 18B is disposed on the second head mounting portion 36*b* of the sub-carriage 26. Similarly, also in the periphery of the boundary between one side (the side which is the upper side in FIG. 14A and the side which is opposite to the partition wall 49 of the one side of the head juxtaposed direction in the state of disposing the second head mounting portion 36*b*) of the width direction (the direction perpendicular to the nozzle row direction in the state of being mounted on the flange portion 52*a*, and a head juxtaposed direction) of the block flange portion 59 and the upper surface of the block flange portion 59, a chamfered portion 61*b* is formed so as to be inclined with respect to the upper surface of the block flange portion 59 when viewing laterally. The inclined angle of the chamfered portion 61*b* with respect to the upper surface of the block flange portion 59 is 45°. As described below, the chamfered portion 61*b* is a surface on which a tapered portion of a θ adjustment pin 66 slides when an angle of a planar direction of the second recording head 18B is adjusted with respect to the sub-carriage 26. The first adjustment block 50*a* is also referred to as an adjustment block of an adjustment side which is a side in which the adjustment is performed due to the adjustment pins 65 and 66 in a position adjustment described below.

A second spring fixing pin 60*b* (a kind of biasing member mounting portion) is erected in the corner portion (the lower left in FIG. 14A) of the upper surface of the block flange portion 59 of the second adjustment block 50*b*. The second spring fixing pin 60*b* is a pin for spanning and passing the second biasing spring 44*b* (refer to FIG. 7) between the second spring fixing pin 60*b* and the second spring fixing pin 42*b* installed on the sub-carriage 26. In addition, in the block flange portion 59, the positioning hole 48 is provided so as to be opened in a state of penetrating the thickness direction of the block flange portion 59 at a position which is deviated from the second spring fixing pin 60*b*. The positioning hole 48 is installed corresponding to the positioning hole 41 of the sub-carriage 26, and is a through-hole to which a positioning pin of a tool is inserted when the second recording head 18B is positioned with respect to the sub-carriage 26. The second adjustment block 50*b* is also referred to as an adjustment block of a supporting point side which becomes a supporting point when the adjustment is performed at the first adjustment block 50*a* side in a position adjustment described below.

At a step before the second recording head 18B is mounted on the sub-carriage 26, as shown in FIGS. 14A and 14B, the adjustment blocks 50*a* and 50*b* are each fixed to both sides of flange portions 52*a* of each second recording head 18B by adhering or screw-fixing and the like in the posture in which the protruded ends of the block flange portion 59 face opposite directions.

The sub-tank 37 is a member for introducing ink from the flow channel member 24 to the pressure chamber side of the recording head 18. The sub-tank 37 includes a self sealing function which opens and closes a valve according to pressure variation in the inner portion and controls the introduction of ink to the pressure chamber side. The flow channel connecting portion 38 to which a connecting flow channel (not shown) of the flow channel member 24 side is connected is installed on both ends in the nozzle row direction in the rear end surface (upper surface) of the sub-tank 37. A ring-shaped packing (not shown) is fitted into the flow channel connecting portion 38, and liquid tightness between the flow channel connecting portion 38 and the flow channel member 24 is secured by the packing. In addition, two driving substrates (not shown) for supplying driving signals to the pressure generating portion are installed in the inner portion of the sub-tank 37. The driving substrate is electrically connected to the signal cable 15, and supplies the driving signals or the like, which is come from the control portion of the printer 1 through the signal cable 15, to the pressure generating portion side via the driving substrate.

In the embodiment, as shown in FIG. 6, in each recording head 18 mounted on the sub-carriage 26, the first recording head 18A and the second recording head 18B including the nozzle row 56 ejecting ink of the same color are formed as a set with each other. Specifically, for example, the recording head H3 of the first recording head 18A which each includes the nozzle row 56 corresponding to yellow ink (Y) and the nozzle row 56 corresponding to black ink (K) and the recording head H4 of the second recording head 18B forms a set, and the recording head H2 of the first recording head 18A which each includes the nozzle row 56 corresponding to magenta ink (M) and the nozzle row 56 corresponding to cyan ink (C) and the recording head H5 of the second recording head 18B forms a set. In addition, the recording head H1 of the first recording head 18A which each includes the nozzle row 56 corresponding to light cyan ink (Lc) and the nozzle row 56 corresponding to light magenta ink (Lm) and the recording head H6 of the second recording head 18B forms a set. Moreover, the recording head 18 is mounted on the sub-carriage 26 so that arrangement of ink colors each assigned to the each nozzle row 56 is symmetrical in the same direction from the center of the head juxtaposed direction (that is, relative movement direction between the head unit 17 and the recording medium S when the recording operation is performed). That is, in the embodiment, the recording head is symmetrically arranged so that a black ink, a yellow ink, a cyan ink, a magenta ink, a light magenta ink, and a light cyan ink are disposed in the order form the center of the head juxtaposed direction toward both ends in the direction. By adopting the positional relationship of each recording head 18 as described above, it is possible to align the landing sequence of ink of each color with respect to the recording medium in a forward path and a return path. Thereby, the sequence in which dots of different colors are overlapped is also aligned in the reciprocation, and therefore, deterioration of the image quality of the recording image can be suppressed. Moreover, a more specific fixing method or the like of each recording head 18 with respect to the sub-carriage 26 will be described below.

Next, manufacturing processes (assembly processes) of the head unit 17 will be described. Here, in the first recording head 18A and the second recording head 18B which form a set, in the first recording head 18A, the adjustment of the fixing position with respect to the sub-carriage 26 is performed so that predetermined nozzles 51 are disposed on a defined position. On the other hand, in the second recording head 18B, the adjustment of the fixing position with respect to the sub-carriage 26 is performed based on the landing position in the recording medium of the ink ejected from the predetermined nozzles 51 of the second recording head 18B with respect to the landing position on the recording medium of the ink ejected from the predetermined nozzles 51 of the first recording head 18A forming a set.

First, the position adjustment and the fixing (mounting process of the first head) of the first recording head 18A will be described.

Figure 15:
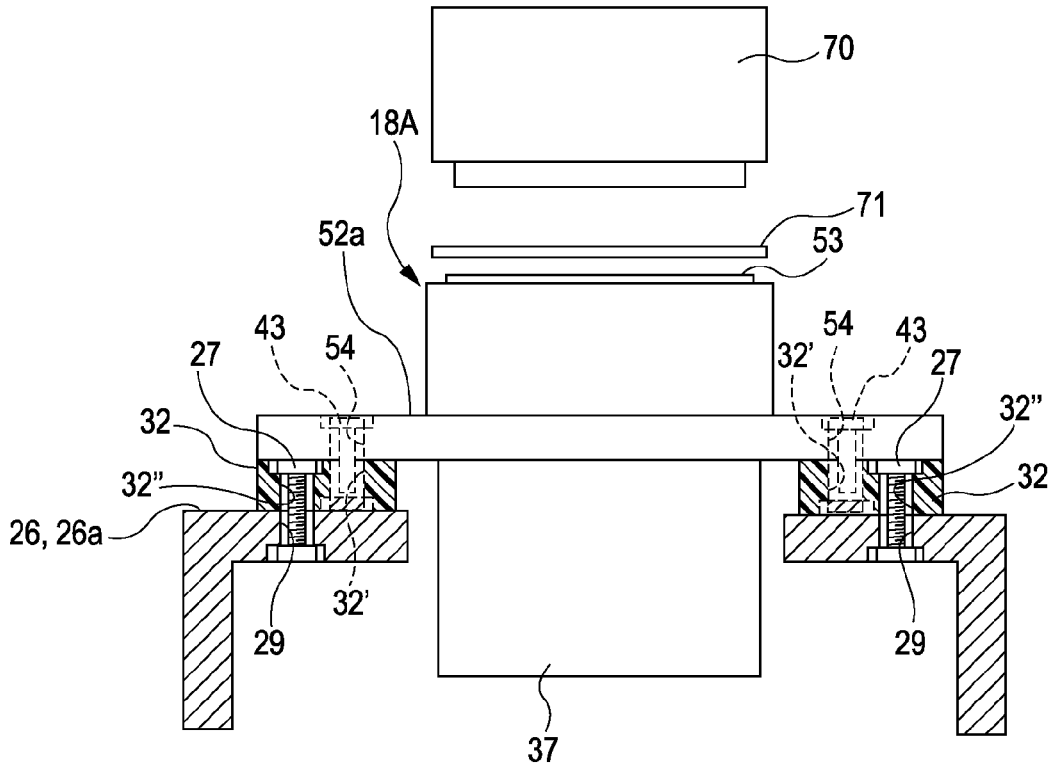
FIG. 15 is a schematic diagram illustrating a configuration of an apparatus for mounting the first recording head to the sub-carriage.

FIG. 15 is a schematic diagram illustrating a configuration of an apparatus for mounting the first recording head 18A on the sub-carriage 26. The apparatus includes an imaging portion 70 such as a CCD camera, a head movement mechanism (not shown) for moving the first recording head 18A, which is a position adjustment target, in the state of holding the recording head, and an alignment substrate 71. In addition, in FIG. 15, the left and right direction is the nozzle row direction, and the depth direction (the perpendicular direction in the drawing) is the direction perpendicular to the nozzle row. The alignment substrate 71 is formed of a plate material having a transmittance such as glass which has as small a linear expansion coefficient as possible. A described below, the alignment substrate 71 includes one set of reference nozzle marks which defines the disposition position of a plurality of (at least two positions) specific nozzles 51 (hereinafter, appropriately referred to as "reference nozzle") of the recording head 18 (hereinafter, appropriately referred to as a "reference head") which is the reference in the position determination, and a target nozzle mark which defines the relative position with respect to the reference nozzle of at least two positions of specific nozzles 51 (hereinafter, appropriately referred to as a "target nozzle") of the first recording head 18A which is the target to be positioned. The formation position of the target nozzle mark is determined so that the relative position with respect to the reference nozzle mark is a designed value (defined position).

In a state where the sub-tank 37 is inserted from the head through-opening 28 and received in the receiving portion and the spacer 32 which is previously fastened to the flange portion 52*a* is interposed between the upper surface of the flange portion 52*a* and the lower surface of the base portion 26*a* of the sub-carriage 26, the first recording head 18A which is the target to be mounted is set in the posture in which the nozzle formation surface 53 face the imaging portion 70. In this state, the first recording head 18A is held by the head movement mechanism.

In the first head mounting process of the embodiment, in the state where the first recording head 18A is held by the head movement mechanism, the relative position of the recording head 18 with respect to the alignment substrate 71 is adjusted on the base portion 26*a* of the sub-carriage 26 by moving the first recording head 18A in the nozzle row direction or the direction perpendicular to the nozzle row direction, or by rotating the first recording head in the direction of the nozzle formation surface.

The first head mounting process, in which each first recording head 18A is mounted on the sub-carriage 26, includes a first position adjustment process which positions the first recording head 18A to a predetermined first head mounting portion 36*a*, a first temporary fixing process which temporarily fixes the first recording head 18A to the base portion 26*a* by adhesive agent, and a first final fixing process (first fixing process) which fixes the first recording head 18A in the temporary fixed state to the base portion 26*a* by the spacer fixing screw 27.

In the embodiment, first, the recording head H1 of the first recording head 18A having a nozzle row 56 corresponding to light cyan ink and light magenta ink is firstly mounted in the first head mounting portion 36*a* of the head juxtaposed direction end (the farthest position from the imaginary partition line Lp, and the left end in FIGS. 11A and 11B) of the sub-carriage 26. In the third head recording head H3, without performing the position adjustment using the alignment substrate 71, the disposition position of the recording head H3 with respect to the sub-carriage 26 is defined (first position adjustment process) by fitting the positioning pin of a tool (not shown) to the positioning hole 73 of the recording head H1 and the positioning hole 72 of the sub-carriage 26 respectively. In this state, the adhesive agent flows between the upper surface of the spacer 32 and the lower surface of the base portion 26*a* due to capillarity, and both are temporarily fixed due to the fact that the adhesive agent is solidified (first temporary fixing process). As the adhesive agent, a so-called instantaneous adhesive agent having cyanoacrylate as the main component is preferable. Moreover, in the positioned state, the spacer 32 and the base portion 26*a* are screwed by using the spacer fixing screw 27, and the recording head H1 is finally fixed at the defined position of the base portion 26*a* (first final fixing process). In this way, the position adjustment of the recording head H1 with respect to the first head mounting portion 36*a* is simply and rapidly completed by using the positioning pin, which can contribute to the foreshortening of the adjustment time. Moreover, in the embodiment, the recording head H1 corresponds to the reference head in the invention. Moreover, the position adjustment of the first recording head 18A which is firstly mounted on the sub-carriage 26 may be also performed by the alignment substrate 71.

Next, while having the recording head H1 which is firstly mounted on the sub-carriage 26 as the reference head, the position of the recording head H2 of the first recording head 18A having nozzle rows 56 corresponding to the magenta ink and the cyan ink is adjusted in the first head mounting portion 36*a* adjacent to the recording head H1, and the recording head H2 is fixed to the sub-carriage 26. In the position adjustment process of the recording head H2 of the first recording head 18A and the recording head H3 of the first recording head 18A, as described above, the position adjustment is performed by using the separated alignment substrate 71. The alignment substrate 71 is disposed between the nozzle formation surface 53 and the imaging portion 70.

In the alignment substrate 71 which is used in the first position adjustment process of the recording head H2, a reference nozzle mark corresponding to the reference nozzle of the recording head H1 which is the reference head, and a target nozzle mark corresponding to the target nozzle of the recording head H2 which is the target head to be mounted are formed. The image which is imaged by the imaging portion 70 is projected to a monitor (not shown). The transparent alignment substrate 71 is overlapped on the nozzle formation surface 53 of the first recording head 18A which is the target to be mounted and projected to the monitor. In addition, based on the image projected to the monitor, the position adjustment of the recording head 18 which is the target to be mounted is performed on the base portion 26*a*. Specifically, first, the position of the alignment substrate 71 is adjusted so that each corresponding reference nozzle mark is overlapped on each reference nozzle of the reference head (in this case, recording head H1) which is projected to the monitor as the image (alignment substrate calibration process).

In addition, the first position adjustment process can be performed without using the illustrated alignment substrate 71. For example, the mark for alignment corresponding to the reference nozzle or the target nozzle of the recording head 18 is displayed on the image which is projected to the monitor, and the position adjustment may be performed based on the mark for alignment. In the above method, the position of the reference mark of the alignment substrate with respect to the each stage movement position in which the mounting operation of the first recording head 18A is performed is stored in a storage portion of a control device, the position adjustment is performed by matching the target nozzle position of the first recording head 18A which is the target to be mounted with respect to the stored position. In addition, due to the fact that the reference nozzle mark is adjusted to fall within the field of the imaging portion 70 with respect to the reference nozzle, position deviation between the reference nozzle and the reference nozzle mark is calculated, the position deviation of the reference nozzle is corrected with respect to the indication value of the position matching when the position matching of the first recording head 18A which is the target to be mounted is performed.

If the position of the alignment substrate 71 is adjusted, next, the position of the recording head H2 is adjusted by the head movement mechanism so that each target nozzle of the recording head H2 which is the target to be mounted is overlapped on the target nozzle mark corresponding on the alignment substrate 71. Thereby, the relative position of the recording head H2 with respect to the recording head H1 is defined on the sub-carriage 26. In addition, in a state where clamping with respect to the recording head H2 is maintained by the head movement mechanism, the adhesive agent flows between the upper surface of the spacer 32 and the lower surface of the base portion 26*a* due to capillarity, and both are temporarily fixed due to the fact that the adhesive agent is solidified (first temporary fixing process). Moreover, in the temporary fixed state, the spacer 32 and the base portion 26*a* are screwed by using the spacer fixing screw 27, and the recording head H2 is finally fixed at the defined position of the base portion 26*a* (first final fixing process).

If the recording head H2 is fixed to the sub-carriage 26, continuously, the position of the recording head H3 of the first recording head 18A having nozzle rows 56 corresponding to the yellow ink and the black ink is adjusted and fixed to the sub-carriage 26. In the alignment substrate 71 which is used in the first position adjustment process of the recording head H3, the reference nozzle mark corresponding to the reference nozzle of the recording head H1 which is the reference head, and a target nozzle mark corresponding to the target nozzle of the recording head H3 which is the target head to be mounted are formed. In addition, similarly to the first position adjustment process with respect to the recording head H2, after the position of the alignment substrate 71 is adjusted so that reference nozzle marks corresponding to each reference nozzle of the recording head H1 which is projected to the monitor as the image are each overlapped, the position of the recording head H3 is adjusted by the head movement mechanism so that each target nozzle of the recording head H3 is overlapped on the corresponding target nozzle mark on the alignment substrate 71. Thereby, the relative position of the recording head H3 with respect to the recording head H1 is defined on the sub-carriage 26.

In this state, the adhesive agent flows between the upper surface of the spacer 32 of the recording head H3 and the lower surface of the base portion 26*a*, and the recording head H3 is temporarily fixed (first temporary fixing process). In addition, in the temporary fixed state, the spacer 32 and the base portion 26*a* are screwed by using the spacer fixing screw 27, and the fifth recording head H5 is finally fixed at the defined position of the base portion 26*a* (first final fixing process).

Figure 17A:
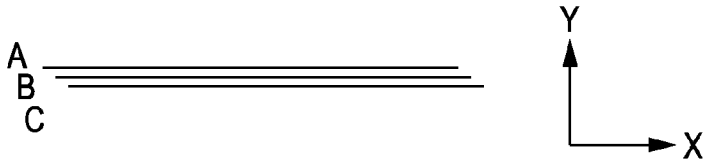
FIGS. 17A and 17B are schematic diagrams illustrating an inclination adjustment in a planar direction of the sub-carriage with respect to a carriage body.
Figure 17B:
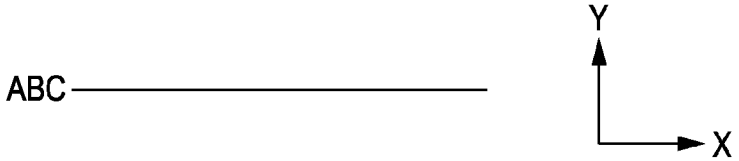

In the processes so far, in the first recording head 18A and the second recording head 18B which form a set, the mounting of the first recording head 18A (recording heads H1 to H3) to the sub-carriage 26 is completed. Next, the second recording head 18B (recording heads H4 to H6) is temporarily disposed to each second head mounting portion 36B of the sub-carriage 26 by using the positioning pin described below (the mounting method will be described in detail below). In this state, the sub-carriage 26 is mounted on the carriage body 12, and inclination adjustment in a planar direction (the direction of the nozzle formation surface) of the sub-carriage 26 with respect to the carriage body 12 is performed. Specifically, while the carriage body 12 is relatively moved in a main scanning direction with respect to the recording medium such as the recording sheet, as shown in FIGS. 17A and 17B, ink is continuously ejected with respect to the recording medium from a predetermined nozzle 51 (for example, the nozzles 51 which are positioned at one end of the nozzle row 56) of each first recording head 18A, and horizontal lines (A to C) are each recorded along the main scanning direction. In the example, the horizontal line formed by the recording head H1 is denoted as A, the horizontal line formed by the recording head H2 is denoted as B, and the horizontal line formed by the recording head H3 is denoted as C. As shown in FIG. 17A, the horizontal lines A to C are each deviated in a sub-scanning direction perpendicular to the main scanning direction, as shown in FIG. 17B, and the position in a planar direction of the sub-carriage 26 with respect to the carriage body 12 is adjusted by the operation of the adjusting levers 20 so that the positions in the sub-scanning direction (Y direction) of each horizontal line A to C are overlapped with each other. Thereby, the nozzle rows 56 of each first recording head 18A are each perpendicular to the main scanning direction. Moreover, in FIGS. 17A and 17B, the inclination adjustment is illustrated based on the horizontal lines which are recorded in the nozzles 51 positioned at one end of the nozzle rows 56. However, from the standpoint of enhancing accuracy, the inclination adjustment may be performed so that the horizontal lines recorded at all nozzles 51 constituting the nozzle rows 56 are overlapped by each first recording head 18A. In the case where the position adjustment is performed at all the nozzles 51, since the adjustment time is longer to a corresponding extent, by sampling the nozzles 51, that is, by filtering a number of nozzles, the adjustment may be performed.

If the position of the sub-carriage 26 with respect to the carriage body 12 is adjusted, the sub-carriage 26 is screwed by the head unit fixing screw 22 and fixed to the carriage body 12. Next, the position adjustment and the fixing of the second recording head 18B in the sub-carriage 26 (second head mounting process) is performed. In the second head mounting process, there are two methods such as a method in which the mounting process of the second head is performed in the state where the sub-carriage 26 is mounted on the carriage body 12 mounted on the printer 1 and a method in which the sub-carriage 26 is mounted on an apparatus for inspecting only the landing and the mounting process of the second head is performed. In the former method, since the position adjustment is performed in the state of being mounted on the printer 1, the position deviation of each recording head 18 due to applying of stress generated at the time of assembling components of the printer 1 by screws or the like (for example, the stress generated when the sub-carriage 26 is screwed to the carriage body 12) and deforming the sub-carriage 26 can be eliminated. Particularly, the position deviation between the first recording head 18A and the second recording head 18B which forms the same set can be prevented. On the other hand, in the latter method, since the position adjustment can be rapidly performed for units of the sub-carriage 26, for example, there is an advantage in that the maintenance time at the time of repairing or exchanging the recording head 18 can be shortened. Here, the landing detection apparatus used in the latter method is constituted by parts which are needed only to detect the landing position deviation among components of the printer.

Hereinafter, the procedure which performs the head mounting process by the former method will be described.

Figure 16A:
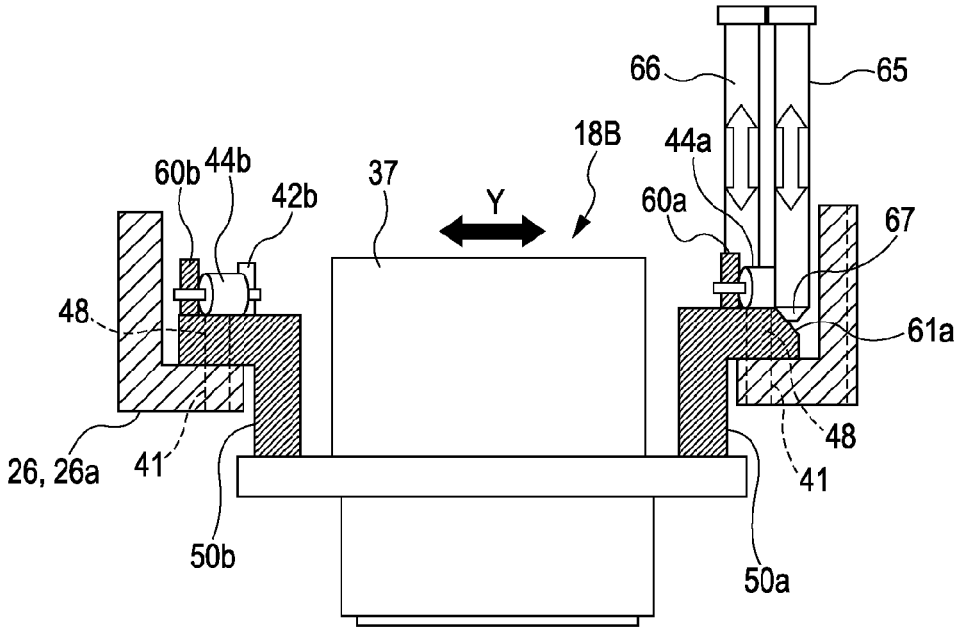
FIGS. 16A and 16B are schematic diagrams illustrating a configuration of an adjustment mechanism for adjusting the position of the second recording head.
Figure 16B:
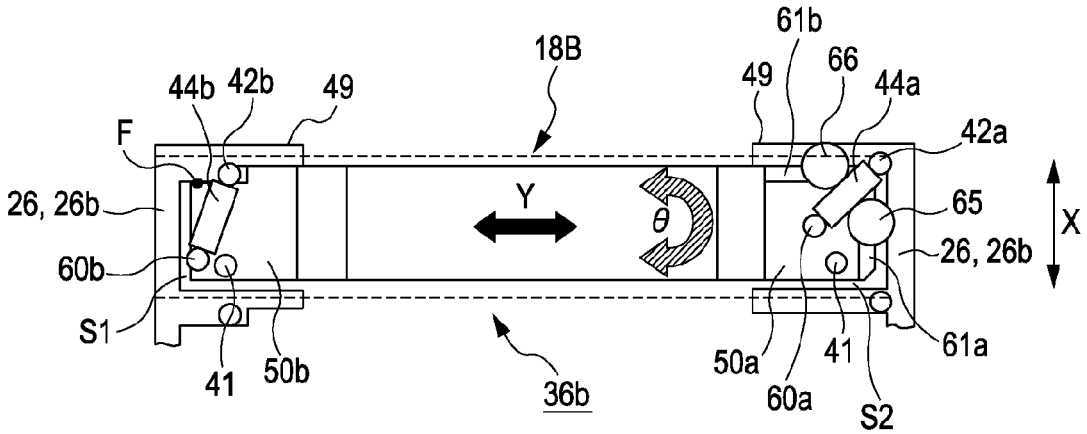

FIGS. 16A and 16B are schematic diagrams illustrating a configuration of an adjustment mechanism which performs the position adjustment of the second recording head 18B with respect to the sub-carriage 26, FIG. 16A shows the aspect when viewing at the side, and FIG. 16B shows the aspect when viewing at the top. In the second recording head 18B, the disposition position (the relative position with respect to the first recording head 18A in the same set) of the second recording head 18B with respect to the sub-carriage 26 is adjusted by using the Y-direction adjustment pin 65 and the θ adjustment pin 66 while observing the landing position of the ink when ink is ejected with respect to the recording medium from a predetermined nozzle 51.

In the step before the sub-carriage 26 is mounted on the carriage body 12, each second recording head 18B is inserted from the head through-opening 28 to the block flange portion 59 of the adjustment block 50 and seated on the upper surface (the bottom surface of the receiving portion) of the base portion 26*a* of the sub-carriage 26. Therefore, each second recording head 18B is disposed on the second head mounting portion 36*b*. In this state, since a positioning pin of a tool (not shown) is inserted to the positioning hole 41 of the sub-carriage 26 side and the positioning hole 48 of the adjustment block 50, a rough position with respect to the sub-carriage 26 is defined. In addition, in the position adjustment process described below, the positioning pin is removed.

Moreover, the first biasing spring 44*a* spans and is passed between the spring fixing pin 60*a* of the first adjustment block 50*a* which is the adjustment block of the adjustment side and the spring fixing pin 42*a* of the sub-carriage 26 side, and the second biasing spring 44*b* spans and is passed between the spring fixing pin 60*b* of the second adjustment block 50*b* which is the adjustment block of the supporting point side and the spring fixing pin 42*b* of the sub-carriage 26 side. Thereby, in the sub-carriage 26, the second recording head 18B which is the target to be mounted is biased to the one side (right side in FIGS. 16A and 16B) of the direction (Y-direction (nozzle row direction)) along the partition wall 49, and biased to one side (upper side in FIGS. 16A and 16B) of the direction (X-direction) perpendicular to the partition wall 49. In addition, in the second head mounting portion 36*b*, a space in which the second recording head 18B can move between the second recording head 18B and the erected wall portion 26*b* of the sub-carriage 26 and the partition wall 49 (that is, the partition wall of the second head mounting portion 36*b*) can be secured.

As described above, after the inclination adjustment in the planar direction of the sub-carriage 26 with respect to the carriage body 12 is performed, the process in which each second recording head 18B (H4 to H6) is mounted on the sub-carriage 26 is performed. The second head mounting process, in which each second recording head 18B is mounted on the sub-carriage 26, includes a second position adjustment process which positions the second recording head 18B to a predetermined second head mounting portion 36*b* of the base portion 26*a*, a second temporary fixing process which temporarily fixes the second recording head 18B to the base portion 26*a* by adhesive agent, and a second final fixing process (second fixing process) which fixes the second recording head 18B in the temporary fixed state to the base portion 26*a*.

In the second position adjustment process, as shown in FIGS. 7 to 9 and FIGS. 16A and 16B, the Y-direction adjustment pin 65 (a kind of first adjustment member) and the θ adjustment pin 66 (a kind of second adjustment member) are each set with respect to each second recording head 18B. The adjustment pins 65 and 66 are an elongated cylindrical member, and the tapered portion 67 is formed at the tip end. In the embodiment, the inclination angle of the tapered portion 67 with respect to the shaft direction of the adjustment pin when viewing laterally is set to 45°. The shaft directions of the adjustment pins 65 and 66 are held so as to be perpendicular to the base portion 26*a* of the sub-carriage 26 in the position adjustment process of the second recording head 18B by a tool (not shown), and the inclined surface of the tapered portion 67 contacts so as to be parallel to the inclined surface of the chamfered portion 61 of the first adjustment block 50*a* of the second recording head 18B which is disposed on the second head mounting portion 36*b* and is the target to be mounted. Specifically, the tapered portion 67 of the Y-direction adjustment pin 65 is set so as to contact the chamfered portion 61*a*, and the tapered portion 67 of the θ adjustment pin 66 is set so as to contact the chamfered portion 61*b*. An adjustment mechanism of the invention includes the spring fixing pin 60*a* of the first adjustment block 50*a*, the spring fixing pin 42*a* of the sub-carriage 26 side, the first biasing spring 44*a*, the spring fixing pin 60*b* of the second adjustment block 50*b*, the spring fixing pin 42*b* of the sub-carriage 26 side, the second biasing spring 44*b*, the Y-direction adjustment pin 65, and the θ adjustment pin 66.

In addition, as shown by white arrows in FIG. 16A, the adjustment pins 65 and 66 are each constituted so as to be lifted or lowered by a predetermined amount in the vertical direction with respect to the base portion 26*a* of the sub-carriage 26 according to an indication (feed ratio) of a micrometer (not shown). If the Y-direction adjustment pin 65 is lowered, according to this, the first adjustment block 50*a* slides so as to be pushed to the other side of the Y-direction while making the inclined surface of the chamfered portion 61*a* slide on the inclined surface of the tapered portion 67 of the Y-direction adjustment pin 65. Thereby, all the second recording head 18B moves from one side in the Y-direction toward the other side thereof while resisting the biasing force of the biasing springs 44*a* and 44*b*. On the contrary, according to lifting the Y-direction adjustment pin 65, the first adjustment block 50*a* slides so as to be drawn from the other side of the Y-direction to one side thereof by the biasing force of the biasing springs 44*a* and 44*b* while making the inclined surface of the chamfered portion 61*a* slide on the inclined surface of the tapered portion 67 of the Y-direction adjustment pin 65. Thereby, all the second recording head 18B moves from the other one side of the Y-direction toward one side.

In addition, if the θ adjustment pin 66 is lowered, according to this, the first adjustment block 50*a* slides so as to be pushed from one side in the X-direction toward the other side thereof while making the inclined surface of the chamfered portion 61*b* slide on the inclined surface of the tapered portion 67 of the Y-direction adjustment pin 65. Here, since the second adjustment block 50*b* is biased to one side of the X-direction perpendicular to the Y-direction by the second biasing spring 44*b*, the contact state of at least one portion of the second adjustment block 50*b* and the partition wall 49 is maintained, and having the contact portion (portion indicated by F in FIG. 16B) as the rotation center (supporting point), the second recording head 18B is rotated in a clockwise direction of FIG. 16B in the nozzle formation surface direction while resisting the biasing force of the basing springs 44*a* and 44*b*. On the contrary, if the θ adjustment pin 66 is lifted, the first adjustment block 50*a* slides so as to be drawn from the other side of the X-direction to one side thereof by the biasing force of the first biasing spring 44*a* while making the inclined surface of the chamfered portion 61*b* slide on the inclined surface of the tapered portion 67 of the θ adjustment pin 66. Thereby, the second recording head 18B is rotated in a counter-clock direction of FIG. 16B in the nozzle formation surface direction by the biasing force of the basing springs 44*a* and 44*b* while having the contact portion F as the rotation center.

Figure 18A:
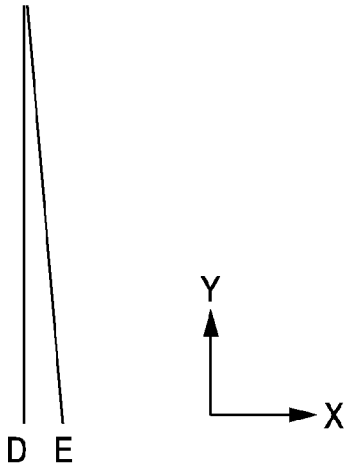
FIGS. 18A and 18B are schematic diagrams illustrating a θ adjustment.
Figure 18B:
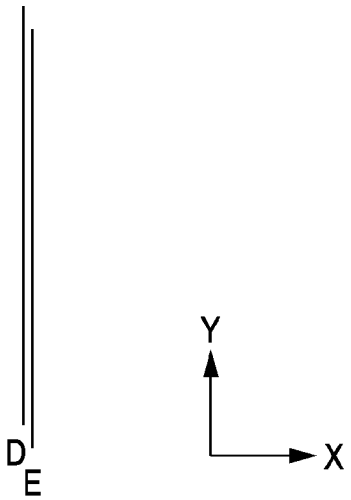
Figure 19A:
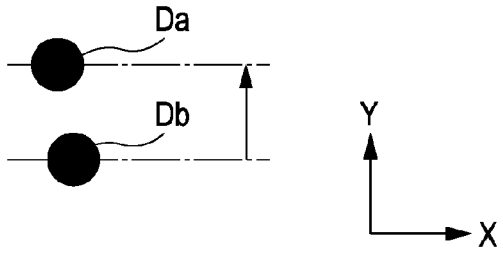
FIGS. 19A and 19B are schematic diagrams illustrating a Y-direction adjustment.
Figure 19B:
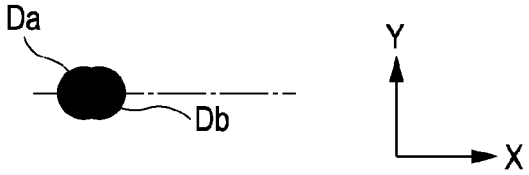

FIGS. 18A to 19B are schematic diagrams illustrating a dot position in a second position adjustment process, FIGS. 18A and 18B are diagrams for explaining with respect to the θ adjustment, and FIGS. 19A and 19B are diagrams for explaining with respect to the Y-direction adjustment.

In the second position adjustment process, first, adjustment of an angle in the nozzle formation surface direction of the second recording head 18B with respect to the first recording head 18A is performed. In the θ adjustment process, as described above, after the position of the second head 18B which is the target to be mounted is set so as to be adjusted, ink is ejected from each nozzle 51 of a predetermined nozzle row 56 of the first recording head 18A which forms a set, and vertical lines (indicated as D in FIGS. 18A and 18B) are recorded on the recording medium. Continuously, at the time when the carriage body 12 moves in the main scanning direction with respect to the recording medium only by the distance corresponding to the gap (the gap on design) between the first recording head 18A and the second recording head 18B, ink is ejected from each nozzle 51 of the nozzle row 56 (in the configuration including a plurality of nozzle rows 56, the nozzle row 56 of the same color as the nozzle row 56 which records the vertical line D in the first recording head 18A) of the second recording head 18B, and a vertical line (indicated as E in FIGS. 18A and 18B) is recorded on the recording medium. In addition, as shown in FIG. 18A, when the recorded vertical line E is inclined to the vertical line D, as shown in FIG. 18B, the angle θ in the nozzle formation surface direction of the second recording head 18B is adjusted by using the θ adjustment pin 66 so that the lines E and D are parallel to each other. For example, by measuring the inclined angle of the vertical line E with respect to the vertical line D through a measurement device (not shown), or by observing the inclined angle through a visual observation of an operator, the θ adjustment pin 66 is lifted or lowered according to the inclined angle, and the angle (inclination) in the nozzle formation surface direction of the second recording head 18B is adjusted. After the adjustment, similarly, the vertical line D and the vertical line E are recorded, and the inclined state of the vertical line E with respect to the vertical line D is observed. In addition, the similar procedures are repeated until both lines are parallel to each other. In this way, the nozzle row 56 of the second recording head 18B is adjusted so as to be parallel with respect to the nozzle row 56 of the first recording head 18A. Moreover, the deviation in the X-direction of the vertical lines D and E can be corrected by adjusting through the control of the timing which ejects ink from the nozzle 51. However, the detailed description is omitted.

If the adjustment of the angle θ in the nozzle formation surface direction of the second recording head 18B is completed, continuously, the position adjustment in the Y-direction of the second recording head 18B is performed. In the position adjustment process in the Y-direction, first, as shown in FIGS. 19A and 19B, ink is ejected from predetermined nozzles 51 (for example, the nozzles 51 which are positioned in the one end of any one nozzle row 56) of the first recording head 18A which forms a set, and a dot (Da) (reference dot) is recorded on a predetermined position of the recording medium. Continuously, at the time when the carriage body 12 moves in the main scanning direction with respect to the recording medium only by the distance corresponding to the gap between the first recording head 18A and the second recording head 18B, the ink is ejected from predetermined nozzles 51 of the second recording head 18B (the nozzles 51 corresponding to the nozzles 51 which record the dot Da in the first recording head 18A) and a dot Db is recorded on the recording medium. In addition, as shown in FIG. 19A, when the recorded dot Db is deviated in the Y-direction with respect to the dot Da, as shown in FIG. 19, the position in the Y-direction of the second recording head 18B is adjusted by using the Y-direction adjustment pin 65 so that the positions in the Y-direction of both dots Da and Db coincide with each other. For example, by measuring the position deviation in the Y-direction of the dot Db with respect to the dot Da through a measurement device (not shown), or by observing the position deviation through a visual observation of an operator, the Y-direction adjustment pin 65 is lifted or lowered according to the deviation amount, and the position in the Y-direction of the second recording head 18B is adjusted. After the adjustment, similarly, the dot Da and the dot Db are recorded, and the position deviation in the Y-direction of the dot Db with respect to the dot Da is observed. In addition, the similar procedures are repeated until both positions in the Y-direction coincide with each other. In this way, the position in the Y-direction (that is, the sub-scanning direction perpendicular to the main scanning direction) of the second recording head 18B with respect to the first recording head 18A is adjusted so as to coincide with each other.

The above-described second position adjustment process is sequentially performed with respect to each second recording head 18B (H4 to H6). In the embodiment, first, after the position adjustment with respect to the recording head H4 of the second recording head 18B having nozzle rows 56 corresponding to the yellow ink and the black ink is performed, the recording head is fixed to the sub-carriage 26 (second final fixing process). The fixing method of the second recording head 18B to the sub-carriage 26 includes a temporary fixing by an adhesive agent (second temporary fixing process) and a final fixing by fastening members such as a fixing screw (second final fixing process). That is, similarly to the first recording head 18A, the adhesive agent flows between lower surfaces of both sides of adjustment blocks 50*a* and 50*b* and the upper surface of the base portion 26*a* due to capillarity, and both are temporarily fixed due to the fact that the adhesive agent is solidified. Thereafter, the adjustment blocks 50*a* and 50*b* and the base portion 26*a* are screwed by using fastening members such as the fixing screw (not shown), and the second recording head 18B is finally fixed at the defined position in the second head mounting portion 36*b* of the sub-carriage 26.

In this way, after the recording head H4 is fixed to the sub-carriage, continuously, the relative position of the recording head H5 of the second recording head 18B having the nozzle row 56 corresponding to the magenta ink (M) and the nozzle row 56 corresponding to the cyan ink (C) is adjusted with respect to the recording head H2 of the first recording head 18A which forms a set. Therefore, the recording head H5 is fixed to the sub-carriage 26. Finally, after the relative position of the recording head H6 of the second recording head 18B having the nozzle row 56 corresponding to the light cyan ink and the nozzle row 56 corresponding to the light magenta ink is adjusted with respect to the recording head H1 of the first recording head 18A which forms a set, the recording head H6 is fixed to the sub-carriage 26.

Due to the fact that the head mounting processes of each recording head 18 with respect to the sub-carriage 26 are sequentially performed by the above-described procedure, each recording head 18 is fixed to the sub-carriage 26 in the state where the recording head 18 is positioned with high accuracy. As described above, with regard to the position adjustment of the recording head 18, in one side of the first recording head 18A which has the nozzle row 56 ejecting the ink of the same color and forms a set, the one side of first recording head 18A is fixed in the state of being positioned with respect to the first head mounting portion 36*a* of the sub-carriage 26 so that the target nozzles are disposed in the defined position. On the other hand, in the other side of the second recording head 18B, based on the landing position in the recording medium of the ink which is ejected from predetermined nozzles 51 of the second recording head 18B with respect to the landing position in the recording medium of the ink which is ejected from predetermined nozzles 51 of the first recording head 18A which forms a set, the second recording head 18B is fixed to the sub-carriage 26 in the state where the relative position of the second recording head 18B with respect to the first recording head 18A is defined by the adjustment mechanism. Therefore, particularly, the positional relationship of the recording heads of the same set having the nozzle row 56 of the same color is secured with higher accuracy. That is, since the relative position of the recording heads 18 of the same set is defined based on an actual ink landing position, inherent characteristics of every recording head such as the inclination of the nozzles 51 to the nozzle formation surface 53 are reflected. In addition, in the embodiment, in the configuration which includes the set of the recording head 18 having the nozzle row 56 of the same color in a plurality, the landing position deviation between the inks of the same color can be prevented. Thereby, when an image or the like is recorded with respect to the recording medium, deterioration of image quality of a recording image or the like due to the landing position deviation can be suppressed.

Moreover, compared to the position adjustment method based on the position of the nozzles 51, the position adjustment method based on the actual landing position on the recording medium of the ink which is ejected from the nozzles 51 needs more adjusting time. However, since the latter position adjustment method having relatively short adjusting time is adopted to one side of the first recording head 18A forming a set, with regard to the entire recording head 18, the overall adjusting time can be shortened compared to the case in which the former position adjusting method is adopted. As a result, decrease in the productivity or the like can be suppressed.

Thereafter, the flow channel member 24 is fixed to the sub-carriage 26 (flow channel mounting process). As described above, the flow channel member 24 is fixed to the sub-carriage 26 by the flow channel fixing screw 45. At this time, a connecting flow channel 40 of the flow channel member 24 is inserted to the flow channel connecting portion 38 of the sub-tank 37 of each recording head 18 and connected in a liquid-tight state. In addition, in the step before each recording head 18 is mounted on the sub-carriage 26, the flow channel member 24 may be fixed to the sub-carriage 26.

In addition, the invention is not limited to the above-described embodiments, and various modifications can be performed based on the description of claims.

Figure 20:
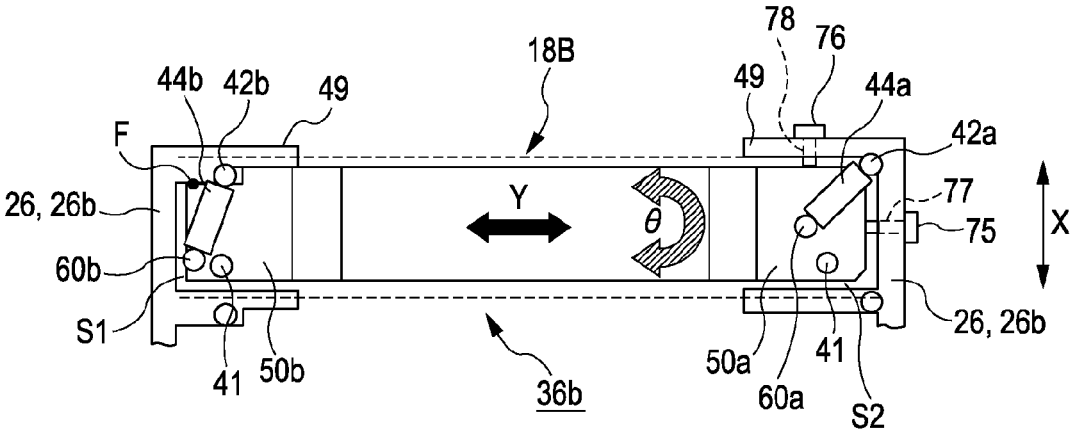
FIG. 20 is a view illustrating a position adjustment of the second recording head according to a second embodiment.

FIG. 20 is a plan view illustrating an adjustment mechanism with respect to the second recording head 18B according to a second embodiment. In the first embodiment, the adjustment pins 65 and 66 are exemplified as one of the constitution members of the adjustment mechanism. However, in the second embodiment, adjustment screws 75 and 76 are adopted instead of the adjustment pins 65 and 66. The Y-direction adjustment screw 75 (a kind of first adjustment member) of one side of the adjustment screws is mounted in a state where a shaft portion of the adjustment screw 75 penetrates a screw hole 77, which is provided so as to be opened in one side of erected wall portion 26*b* in the nozzle row direction among the erected wall portions 26*b* partitioning the second head mounting portion 36*b*, from the outside and the tip of the adjustment screw 75 abuts the first adjustment block 50*a* of the second recording head 18B which is disposed on the second head mounting portion 36*b*. In addition, if the Y-direction adjustment screw 75 is rotated in a clockwise direction, according to this, an amount of the shaft portion protruded from the erected wall portion 26*b* is increased. Thereby, all the second recording head 18B moves from one side in the Y-direction toward the other side thereof while resisting the biasing force of the biasing springs 44*a* and 44*b*. On the other hand, if the Y-direction adjustment screw 75 is rotated in a counter clockwise direction, according to this, an amount of the shaft portion protruded from the erected wall portion 26*b* is decreased. Thereby, all second recording head 18B entirely moves from the other side in the Y-direction toward one side thereof by the biasing force of the biasing springs 44*a* and 44*b*.

The θ adjustment screw 76 (a kind of second adjustment member) of one side of the adjustment screws is mounted in a state where a shaft portion of the adjustment screw 75 penetrates a screw hole 78, which is provided so as to be opened in one side of partition wall 49 among the partition walls 49 partitioning the second head mounting portion 36*b*, from the outside and the tip of the adjustment screw 75 abuts the first adjustment block 50*a* of the second recording head 18B which is disposed on the second head mounting portion 36*b*. In addition, if the θ adjustment screw 76 is rotated in a clockwise direction, according to this, an amount of the shaft portion protruded from the partition wall 49 is increased. Thereby, as having the contact portion F between the second adjustment block 50*b* and the partition wall 49 as the rotation center, the second recording head 18B is rotated in a clockwise direction of FIG. 20 in the nozzle formation surface direction while resisting the biasing force of the biasing springs 44*a* and 44*b*. On the other hand, if the θ adjustment screw 76 is rotated in a counter clockwise direction, according to this, an amount of the shaft portion protruded from the erected wall portion 26*b* is decreased. Thereby, by having the contact portion F as the rotation center, the second recording head 18B is rotated in a counter clockwise direction of FIG. 20 in the nozzle formation surface direction by the biasing force of the biasing springs 44*a* and 44*b*.

In this way, similarly to the configuration which adopting the adjustment pins 65 and 66, by using the adjustment screws 75 and 76, the Y-direction position and the inclination in the nozzle formation surface direction of the second recording head 18B can be adjusted. Since other configurations are similar to those of the first embodiment, the descriptions are omitted.

Except for that, if it is possible to adjust the Y-direction position and the inclination in the nozzle formation surface direction of the second recording head 18B, the invention is not limited to the adjustment pins 65 and 66 or the adjustment screws 75 and 76 described in each embodiment. For example, a shim (spacer) or the like can be used.

Moreover, in regard to the configuration or the number of the recording heads 18 mounted on the sub-carriage 26 which is a head fixing member, the invention is not limited to those exemplified in the embodiments. In addition, in the first embodiment, in the sub-carriage 26, the configuration is exemplified in which three first recording heads 18A are mounted on the first head mounting portions 36*a* which are the half of one side from the imaginary partition line Lp (FIGS. 11A and 11B) of the center of the head juxtaposed direction and three second recording heads 18B are mounted on the remaining half of second head mounting portions 36*b*. However, the invention is not limited to this. For example, the invention may be applied to even a configuration in which the first recording heads 18A and the second recording heads 18B are alternatively disposed in the head juxtaposed direction. In the configuration, since only at least one recording head is empty in the gap between the first recording heads 18A, in the process after the first recording head 18A is fixed to the sub-carriage 26, accuracy of the inclination adjustment in the planar direction of the sub-carriage 26 with respect to the carriage body 12 described above with reference to FIGS. 17A and 17B can be improved.

Moreover, in each embodiment, the configuration in which the ink ejection is performed while reciprocating the head unit 17 with respect to the recording medium is described. However, the invention is not limited to this. For example, a configuration can be adopted in which the ink ejection is performed while moving the recording medium with respect to the head unit 17 in a state where the position of the head unit 17 is fixed.

In addition, as described above, the ink jet type printer 1 which is a kind of the liquid ejecting apparatus is described as the example. However, the invention can be applied even to other liquid ejecting apparatuses in which a plurality of liquid ejecting heads is mounted on a head fixing member. For example, the invention can be applied to a display manufacturing apparatus which manufactures color filters such as a liquid crystal display, an electrode manufacturing apparatus which forms electrodes such as an organic electroluminescence display or a field emission display, a bio-chip manufacturing apparatus which manufactures bio-chips (biochemistry elements), or a micropipette which supplies small amount of sample solution in exact amounts.

What is claimed is:

1. A liquid ejecting head unit comprising:

a liquid ejecting head having at least one of nozzle rows including a plurality of nozzles which ejects liquid; and a head fixing member to which a plurality of the liquid ejecting heads is fixed so as to arrange the nozzle rows, wherein two liquid ejecting heads having nozzle rows which eject liquid of the same color form a set as a first head and a second head, the head fixing member includes a first head mounting portion to which the first head is fixed and a second head mounting portion to which the second head is fixed, a first head of the same set is fixed to the first head mounting portion so that the nozzles are disposed in a defined position, and a second head of the same set is fixed to the second head mounting portion based on a landing position of the liquid which is ejected from the nozzles of the second head.

2. A liquid ejecting head unit comprising:

a liquid ejecting head having at least one of nozzle rows including a plurality of nozzles which ejects liquid; and a head fixing member to which a plurality of the liquid ejecting heads is fixed in a state where the nozzle rows are arranged, disposed, and positioned, wherein two liquid ejecting heads having nozzle rows which eject liquid of the same color form a set as a first head and a second head, and at least two sets of each liquid ejecting head are fixed to the head fixing member so that a color arrangement of the liquids each assigned to each nozzle row is symmetrical in the same direction from a center of a juxtaposed direction of each liquid ejecting head, the head fixing member includes a first head mounting portion to which the first head is fixed and a second head mounting portion to which the second head is fixed, the second head mounting portion includes at least a portion of constitution members of an adjustment mechanism which adjusts a position of the second head disposed in the second head mounting portion, a first head of one side of the same set is fixed to the first head mounting portion in a state where the nozzles are positioned so as to be disposed in a defined position, and a second head of the other side of the same set is fixed to the second head mounting portion in a state where a relative position of the second head to the first head is defined by the adjustment mechanism based on a landing position in a landing target of liquid ejected from predetermined nozzles of the second head with respect to a landing position in a landing target of liquid ejected from predetermined nozzles of the first head.

3. The liquid ejecting head unit according to claim 2, wherein the adjustment mechanism includes a biasing member which biases to one side of a head juxtaposed direction of a partition wall which partitions the second head mounting portion and to one side of directions perpendicular to the head juxtaposed direction respectively, a biasing member mounting portion on which the biasing member is mounted, a first adjustment member which adjusts a position in a direction perpendicular to the head juxtaposed direction of the second head disposed on the second head mounting portion in a state of being biased by the biasing member, and a second adjustment member which adjusts an inclination in a nozzle formation surface direction of the second head.

4. The liquid ejecting head unit according to claim 2, wherein one of the first heads of each set is fixed as a reference head with respect to the first head mounting portion, and other remaining first heads are fixed to the first head mounting portions in a state where the relative positions with respect to the reference head are defined.

5. The liquid ejecting head unit according to claim 4, wherein the reference head is fixed in a state of being positioned by a positioning pin with respect to the first head mounting portion.

6. A manufacturing method of a liquid ejecting head unit which includes a liquid ejecting head having at least one of nozzle rows including a plurality of nozzles which ejects liquid, and a head fixing member to which a plurality of the liquid ejecting heads is fixed in a state where the nozzle rows are arranged, disposed, and positioned, and in which two liquid ejecting heads having nozzle rows which eject liquid of the same color form a set as a first head and a second head, and at least two sets of each liquid ejecting head are fixed to the head fixing member so that a color arrangement of the liquids each assigned to each nozzle row is symmetrical in the same direction from a center of a juxtaposed direction of each liquid ejecting head, the manufacturing method comprising:

adjusting a mounting position of a first head of one side of the same set with respect to a first head mounting portion of the head fixing member so that predetermined nozzles are disposed in a defined position;

fixing the first head to the first head mounting portion in a state where the mounting position of the first head is defined by the adjusting of the mounting position;

adjusting the relative position of the second head with respect to the first head by the adjustment mechanism based on a landing position in a landing target of liquid ejected from predetermined nozzles of a second head of the other side of the same set with respect to a landing position in a landing target of liquid ejected from predetermined nozzles of a first head of one side of the same set; and fixing the second head to a second head mounting portion of the head fixing member in a state where the mounting position of the second head is defined by the adjusting of the relative position.

* * * * *